US011810734B2

(12) United States Patent
Hirsch

(10) Patent No.: US 11,810,734 B2
(45) **Date of Patent: *Nov. 7, 2023**

(54) MULTIPLE-POSITION MOMENTARY ELECTRICAL PUSH SWITCH WITH CONFIGURABLE ACTIVATION ZONES

(71) Applicant: Steven B Hirsch, Middleburg, VA (US)

(72) Inventor: Steven B Hirsch, Middleburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/582,549

(22) Filed: Jan. 24, 2022

(65) Prior Publication Data

US 2022/0157540 A1 May 19, 2022

Related U.S. Application Data

(63) Continuation-in-part of application No. 15/679,170, filed on Aug. 17, 2017, now Pat. No. 11,232,919.

(60) Provisional application No. 62/376,292, filed on Aug. 17, 2016.

(51) Int. Cl.

| | |
|---|---|
| ***H01H 13/70*** | (2006.01) |
| ***H01H 13/20*** | (2006.01) |
| ***H01H 13/14*** | (2006.01) |

(52) U.S. Cl.
CPC ..... *H01H 13/70* (2013.01); *H01H 13/14* (2013.01); *H01H 13/20* (2013.01); *H01H 2215/00* (2013.01)

(58) Field of Classification Search
CPC ..... H01H 13/70; H01H 13/14; H01H 13/20; H01H 2215/00
See application file for complete search history.

(56) References Cited

FOREIGN PATENT DOCUMENTS

WO WO-2021237348 A1 * 12/2021 ..... B66B 1/461

* cited by examiner

*Primary Examiner* — Vanessa Girardi

(57) ABSTRACT

A momentary electrical push switch that can be configured for 2 or more activation positions. The switch has a top surface, or "key" top, which is pressed down upon in different areas to actuate the switch's different activation positions. The key top can be of various shapes, such as quadrangles, circle, hexagon, etc., or irregular shapes, to suit a particular application. The key top can be divided into multiple segments, or activation zones, each corresponding to a different activation position of the switch. The key allows free-form movement when pressing down upon it, without requiring the user to use specific or narrowly-defined motions to actuate the various activation positions.

19 Claims, 22 Drawing Sheets

(A – A)

(A – A)

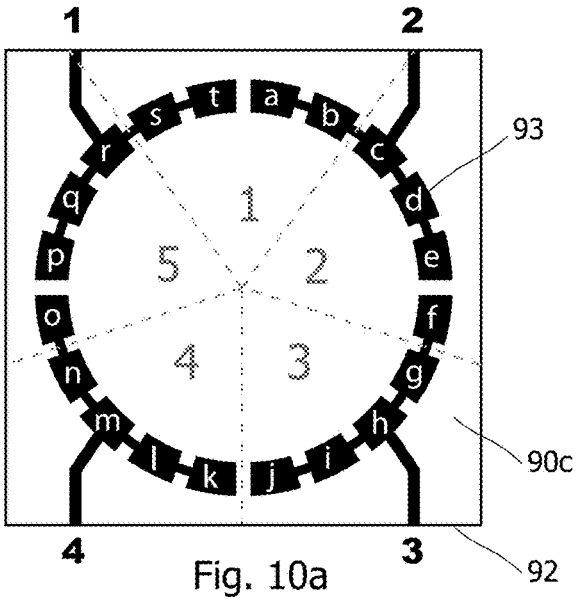
Fig. 10a
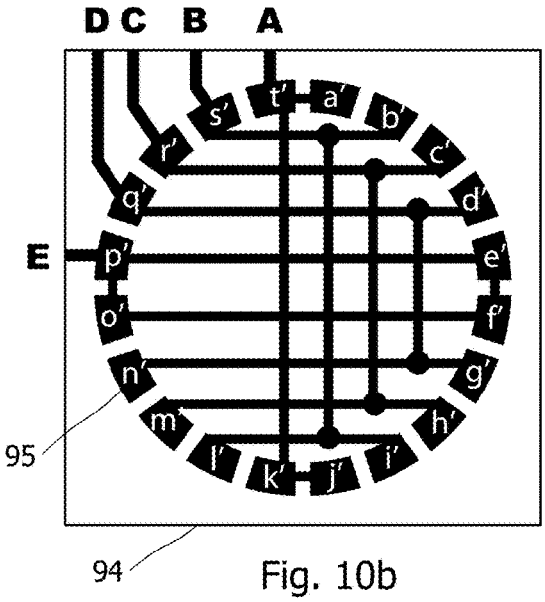
Fig. 10b
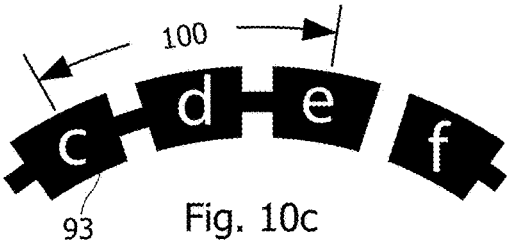
Fig. 10c
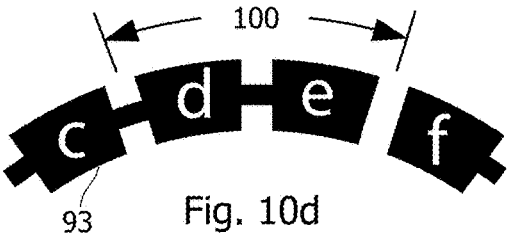
Fig. 10d
Fig. 10e
Table 1
| | Row | Contacts (93/95) pressed simultaneously by contact ring | | | | | | | | | Key segment (90a - 90e) actuated |
|---|---|---|---|---|---|---|---|---|---|---|---|
| | | t/t' | a/a' | b/b' | c/c' | d/d' | e/e' | f/f' | g/g' | h/h' | |
| | 1 | 1+A | 2+A | 2+B | — | — | — | — | — | — | 1 |
| | 2 | — | 2+A | 2+B | — | — | — | — | — | — | 1 |
| | 3 | — | 2+A | 2+B | 2+C | — | — | — | — | — | 1 |
| | 4 | — | — | 2+B | 2+C | — | — | — | — | — | none |
| | 5 | — | — | 2+B | 2+C | 2+D | — | — | — | — | 2 |
| | 6 | — | — | — | 2+C | 2+D | — | — | — | — | 2 |
| *Fig. 10c* → | 7 | — | — | — | 2+C | 2+D | 2+E | — | — | — | 2 |
| *Fig. 10d* → | 8 | — | — | — | — | 2+D | 2+E | — | — | — | 2 |
| | 9 | — | — | — | — | 2+D | 2+E | 3+E | — | — | 2 |
| | 10 | — | — | — | — | — | 2+E | 3+E | — | — | 2 |
| | 11 | — | — | — | — | — | 2+E | 3+E | 3+D | — | 2 |
| | 12 | — | — | — | — | — | — | 3+E | 3+D | — | none |
| | 13 | — | — | — | — | — | — | 3+E | 3+D | 3+C | 3 |

(A – A)

(B – B)

(A – A)

(A – A)

(A – A)

(A – A)

(B – B)

(A – A)

(A – A)

(A – A)

(A – A)

MULTIPLE-POSITION MOMENTARY ELECTRICAL PUSH SWITCH WITH CONFIGURABLE ACTIVATION ZONES

CROSS REFERENCE TO RELATED APPLICATION

This application claims the benefit of U.S. Provisional Application 62/376,292, filed Aug. 17, 2016, and U.S. application Ser. No. 15/679,170, filed Aug. 17, 2017, which are hereby incorporated by reference herein in their entirety.

SUMMARY OF THE INVENTION

This invention provides a momentary electrical push switch that can be configured for 2 or more activation positions. The switch has a top surface, or "key" top, which is pressed down upon in different areas to actuate the switch's different activation positions. The key top can be of various shapes, such as quadrangles, circle, hexagon, etc., or irregular shapes, to suit a particular application.

The key top can be graphically and/or topographically divided into multiple segments, or activation zones, each corresponding to a different activation position of the switch. The segments can be of varying sizes and shapes on a given key.

The key allows free-form movement when pressing down upon it, without requiring the user to use specific or narrowly-defined motions to actuate the various activation positions. This is useful and/or necessary where fluidity of motion is required, such as in typing, where users can be operating the keys with great rapidity and with individualized typing styles in which the manner in which they push the keys, and the particular area of the key they strike, can vary widely from user to user.

FIELD OF THE INVENTION

The present invention relates to input devices, particularly to a momentary-action push switch for operation in electronic devices, a push switch with a key-like top actuator button, and a switch with multiple activation positions which outputs different signals in response to pressing forces applied to different areas of the button's top surface.

BACKGROUND OF THE INVENTION

Momentary electrical push switches, particularly with essentially flat tops and with varying shapes, are widely used in electronic devices, for inputting information as well as control commands into the device.

Such switches are typically configured with limited symmetrical activation positions that require the user to use specific or narrowly-defined motions to actuate the various activation positions.

This invention addresses the need for a multi-position push switch which can have activation positions at various non-uniform and/or non-symmetrical areas on the button top, and which allows free-form movement when pressing down upon it, which is advantageous where fluidity of motion is required, such as in typing.

BRIEF DESCRIPTION OF THE DRAWINGS

FIG. 10*a* shows top switch layer (92) with its circle of 20 contacts (93) labeled a-t, which are connected to circuit traces labeled 1-4.

FIG. 10*b* shows bottom switch layer (94) with its circle of 20 contacts (95) labeled a'-t', which are connected to circuit traces labeled A-E.

FIG. 10*c* shows a magnified view of contacts c-f, wherein a key contact ring is making contact with top switch layer (92) below it with a contact section arc (100) that spans contacts c, d and e.

FIG. 10*d* shows a magnified view of contacts c-f, wherein a key contact ring is making contact with top switch layer (92) below it with a contact section arc (100) that spans only contacts d and e.

FIG. 10*e* is a truth table, Table 1, showing the key segment of key (90) shown in FIG. 9*a* actuated for given simultaneous connecting of combinations of contacts t-h of switch layer (92) with corresponding contacts t'-h' of switch layer (94) positioned underneath it.

Figure 19:
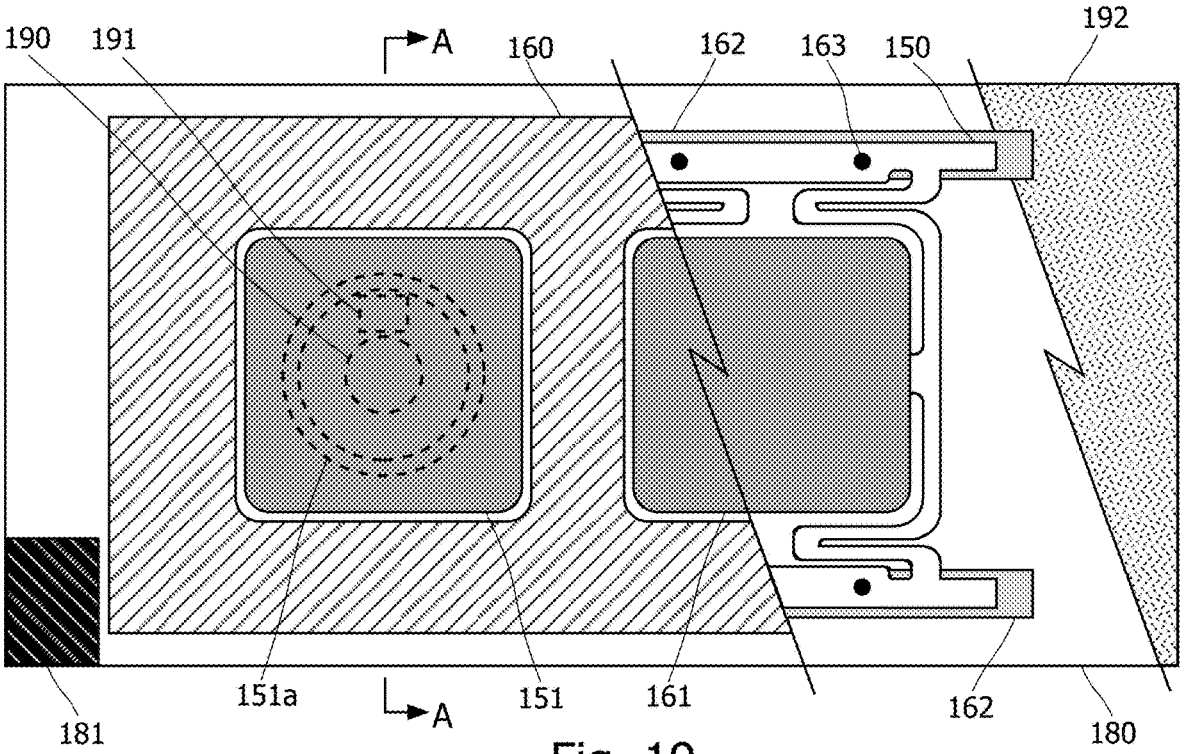
FIG. 19 shows 2 identical keys (151) and (161) surrounded by a faceplate (160) and suspended across 2 support beams (162) by suspension (150), and with dashed outlines indicating locations of contact section (151*a*), a compressible element (190), and a haptic actuator (191) as they would be seen if looking through the top of key (151). Beneath the keys are a membrane switch (180) and a base surface (192) beneath it. Also shown is a haptic actuator (181) located on base surface (192).
Figure 19A:
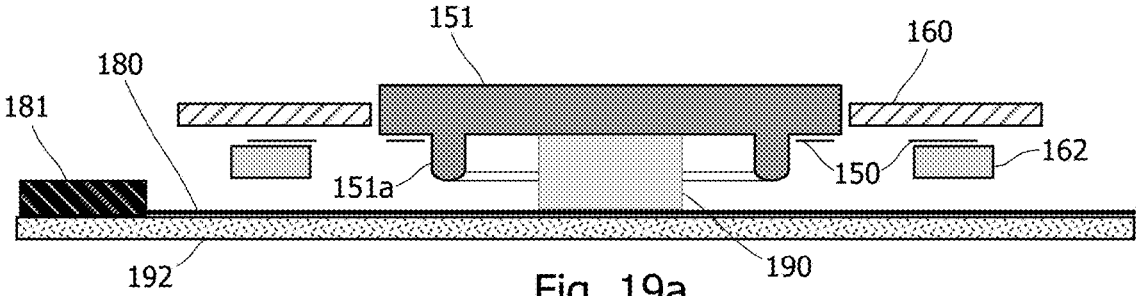
FIG. 19*a* is A-A cross-section of FIG. 19, showing an embodiment in which only haptic actuator (181) is utilized.
Figure 19B:
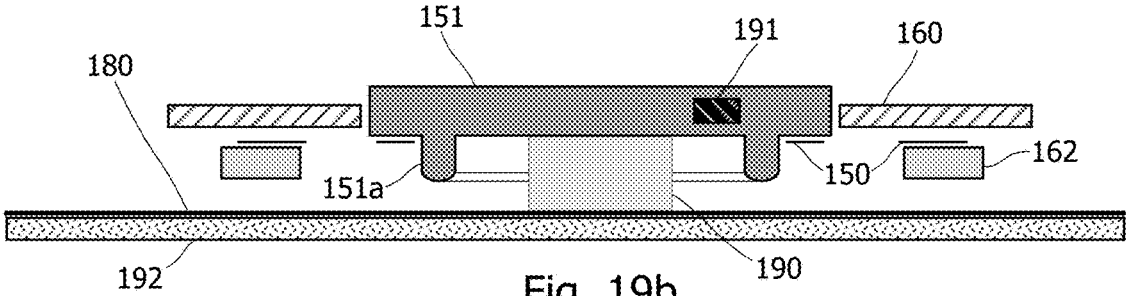
FIG. 19*b* is A-A cross-section of FIG. 19, showing an embodiment in which only haptic actuator (191) is utilized.
Figure 20A:
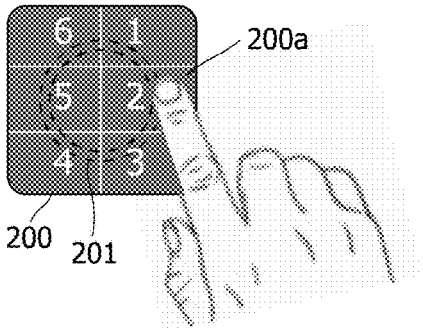
FIG. 20*a* shows the top face of key (200) where the key top is divided into 6 segments corresponding to 6 activation positions similar to key (30) in FIGS. 3*a* and 3*b*, each segment containing a numerical marking on the top face of the key. A contact section (201) of the key is indicated by a dashed outline as it would be seen if looking through the top of the key. A user's finger is shown pressing on segment (200*a*) having the numerical marking "2".
Figure 20B:
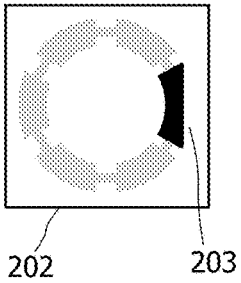
FIG. 20*b* shows a 3-layer electrical switch mechanism (202), such as the switch shown in FIG. 4*c* comprising top, middle and bottom layers (31), (32) and (33) respectively. Switch (202) is located beneath key (200). In this example, switch (202) has a bottom layer constructed of a rigid material with upward-facing electrical contacts, as described in the detailed description of FIG. 3*e*. Switch activation position (203) lies directly beneath, and corresponds to, key segment (200*a*).
Figure 20C:
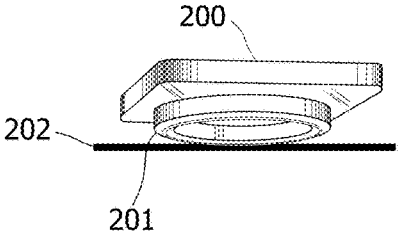
FIG. 20*c* shows a side view of key (200) resulting from a finger pressing down on the key at segment (200*a*) causing contact section (201) to make contact with switch (202) beneath it and actuating the activation position (203) which is directly beneath and corresponds to key segment (200*a*).
Figure 20D:
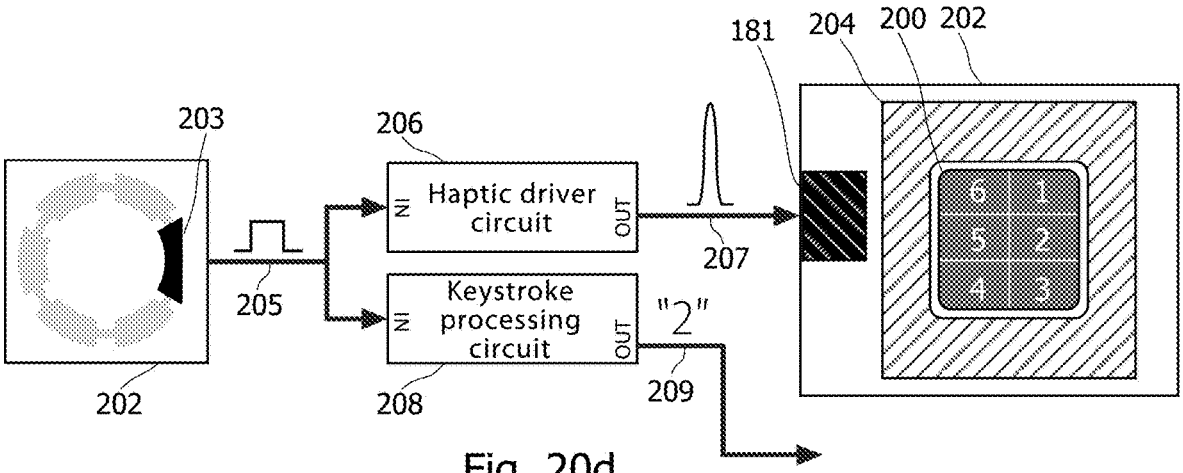
FIG. 20*d* shows an example embodiment where, in response to a user pressing segment (200*a*) of key (200) as shown in FIG. 20*a* which causes contact section (201) to make contact with switch (202) as shown in FIG. 20*c* and actuate activation position (203) shown in FIG. 20*b*: switch (202) sends an actuation signal (205) to haptic driver circuit (206) which then generates electrical output pulse (207) to cause haptic actuator (181) located on switch (202) to generate a mechanical vibration or other type of palpable perturbation to provide the user a haptic response to pressing the key. This example shows actuation signal (205) also being sent to keystroke processing circuit (208) which determines which of the 6 activation positions of the key was pressed (in this example, (200*a*)) and outputs signal (209) corresponding to the digit "2" which is the numeric marking on the top face of the key within segment (200*a*).
Figure 20E:
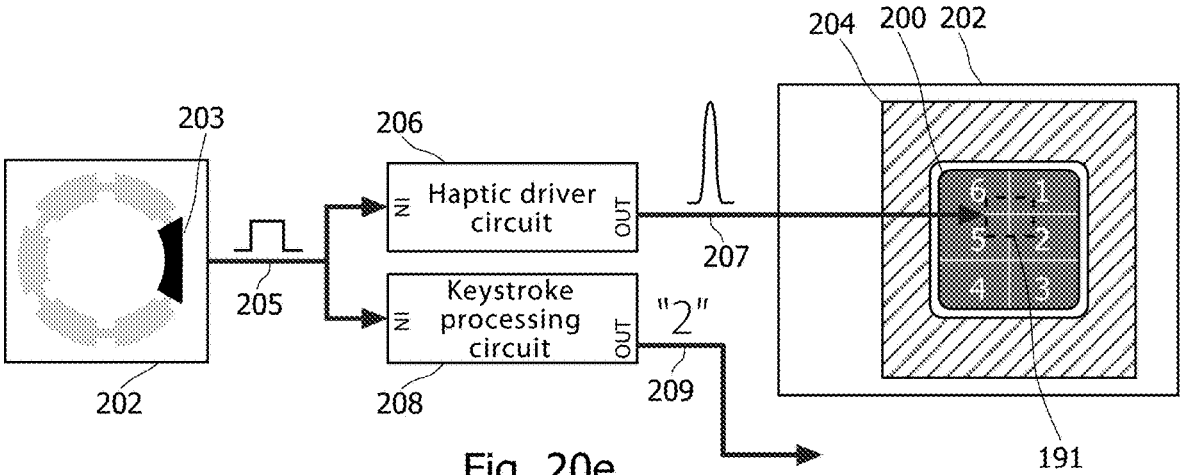

The example shown in FIG. 20*e* is identical to that shown in FIG. 20*d* with the exception that instead of haptic actuator (181) located on switch (202) there is haptic actuator (191) located within key (200), as shown in FIG. 19*b*, with dashed outlines indicated its location as if looking through the top of the key.

Figure 21A:
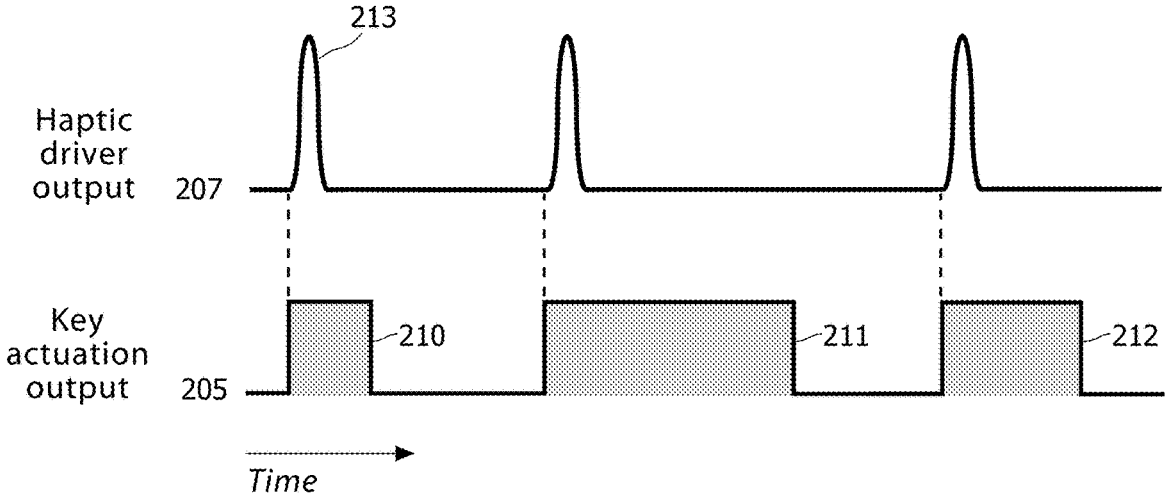

FIG. 21*a* shows an example output (205) from membrane switch (202) in the implementation shown in FIG. 20*d*: output (205) is the result of 3 sequential key presses which produce 3 key actuation signals (210), (211) and (212). The haptic driver produces an output (207) of a single pulse (213) upon each key press.

Figure 21B:
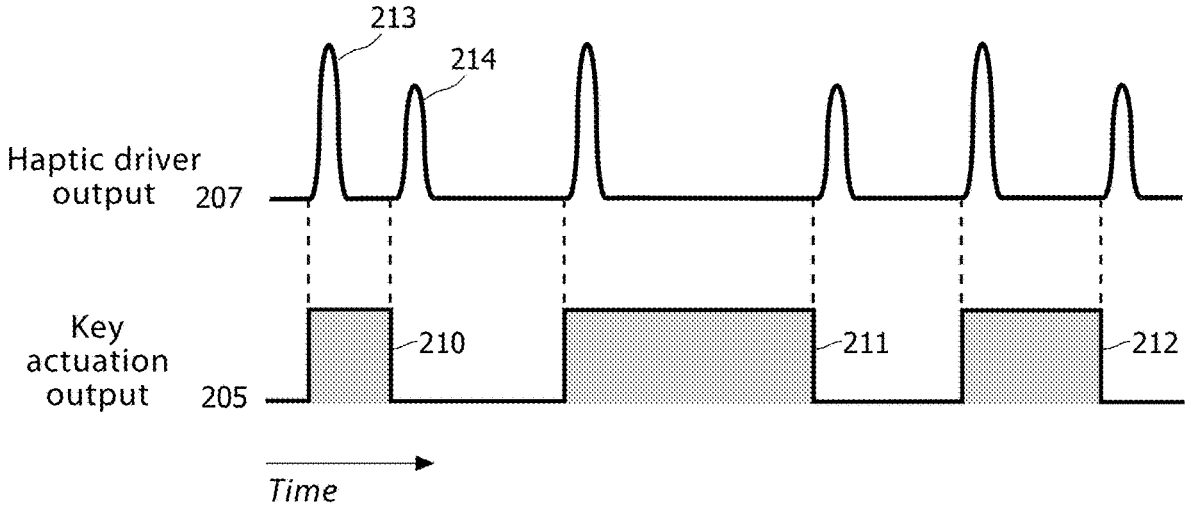

FIG. 21*b* shows the same example output (205) from membrane switch (202) in the implementation shown in FIG. 20*d*, the result of 3 sequential key presses which produce 3 key actuation signals (210), (211) and (212). The haptic driver produces an output (207) of a single pulse (213) upon each key press, and an output pulse (214) upon each subsequent release of the key.

Figure 22:
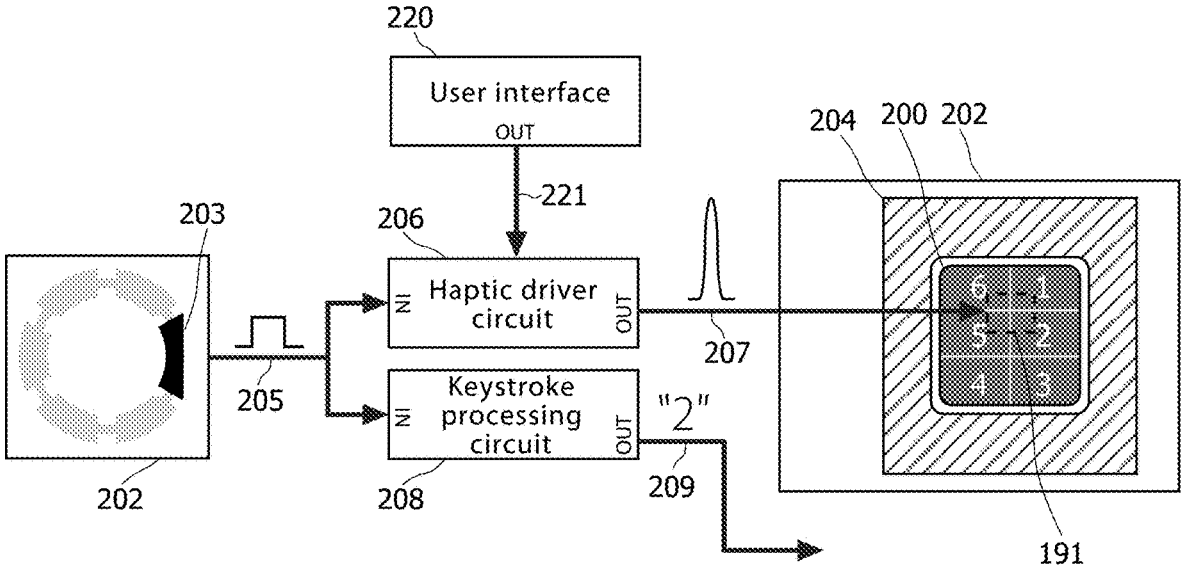

FIG. 22 shows user interface (220) added to the example application shown in FIG. 20*e*. The user interface can allow the user to vary the tactile response feel for key presses by setting control parameters in haptic driver (206), which then controls the output characteristics of haptic actuator (191).

DETAILED DESCRIPTION OF THE DRAWINGS

Figure 1:
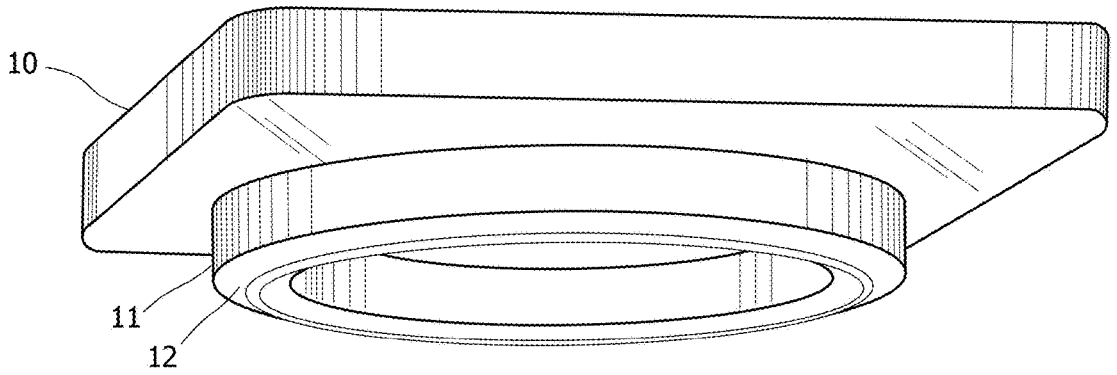
FIG. 1 shows key (10) in a side perspective view, with contact ring (11) extending downward from the bottom face of the key.
Figure 1A:
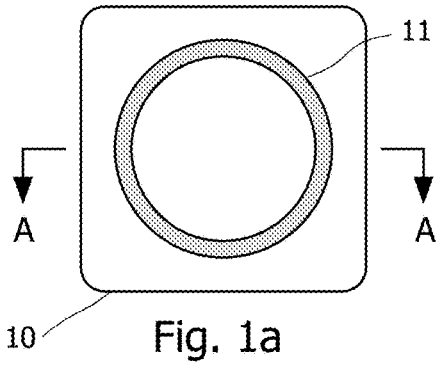
FIG. 1*a* shows a view of key (10) from the bottom, with circular contact ring (11).
Figure 1B:
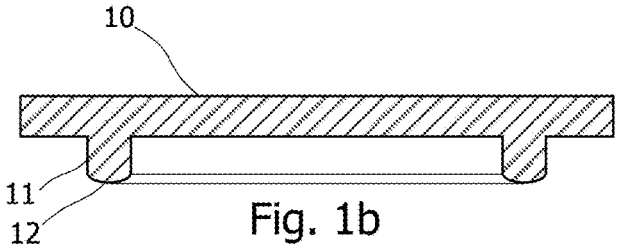
FIG. 1*b* shows a cross-sectional view of key (10) and the contact ring top surface (12).

FIG. 1 shows a preferred embodiment of the key (10) in a side perspective view. A contact ring (11) extends downward from the bottom face of the key. The contact ring top surface (12) is the part of the key that makes contact with an electrical, optical, or electro-mechanical detection mechanism immediately below it to cause actuation of an electrical signal corresponding to which area of the key's top surface has been pressed by the user. In the preferred embodiment shown in FIG. 1, and the corresponding cross-section view of FIG. 1*b*, the contact ring top surface (12) has a rounded profile. FIG. 1*a* shows a view of key (10) from the bottom, with the circular contact ring (11) centered on the key. FIG. 1*b* shows the cross-section of key (10) across the line A-A. Surface (12), as well as part or all of the contact ring, can be constructed from either a rigid, or non-rigid flexible deformable, material.

Figure 1C:
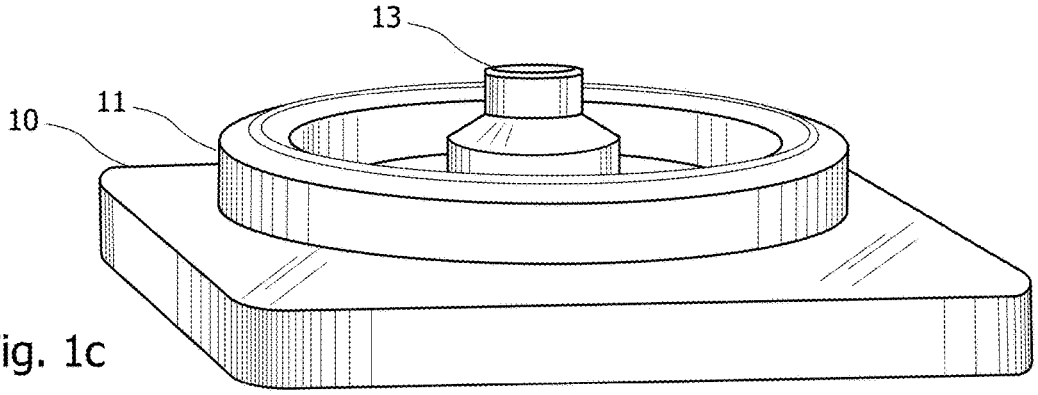
FIG. 1*c* shows a bottom-up side perspective of key (10) with compressible silicone center element (13) located in the center of contact ring (11).

FIG. 1*c* shows a bottom-up side perspective of key (10) with a center element (13) located in the center of the contact ring (11) and extending above the top of the contact ring. The center element shown is a soft-silicone compressible dome typically found in the construction of computer keyboards. A variety of shapes and materials, preferably with flexible and compressible properties, can be used for a center element, with one of the advantages being to provide a tactile feel and response during key depression. A silicone dome such as that shown in FIG. 1*c* can provide a dual-state 'oil can' snap action that is felt when pressing keys on a typical computer keyboard. A center element can also facilitate the key tilting down at an angle when pressed anywhere non-central on its top surface, rather than the entire key moving down in a horizontal disposition. A center element is not required for the operation of the key, however.

Figure 2:
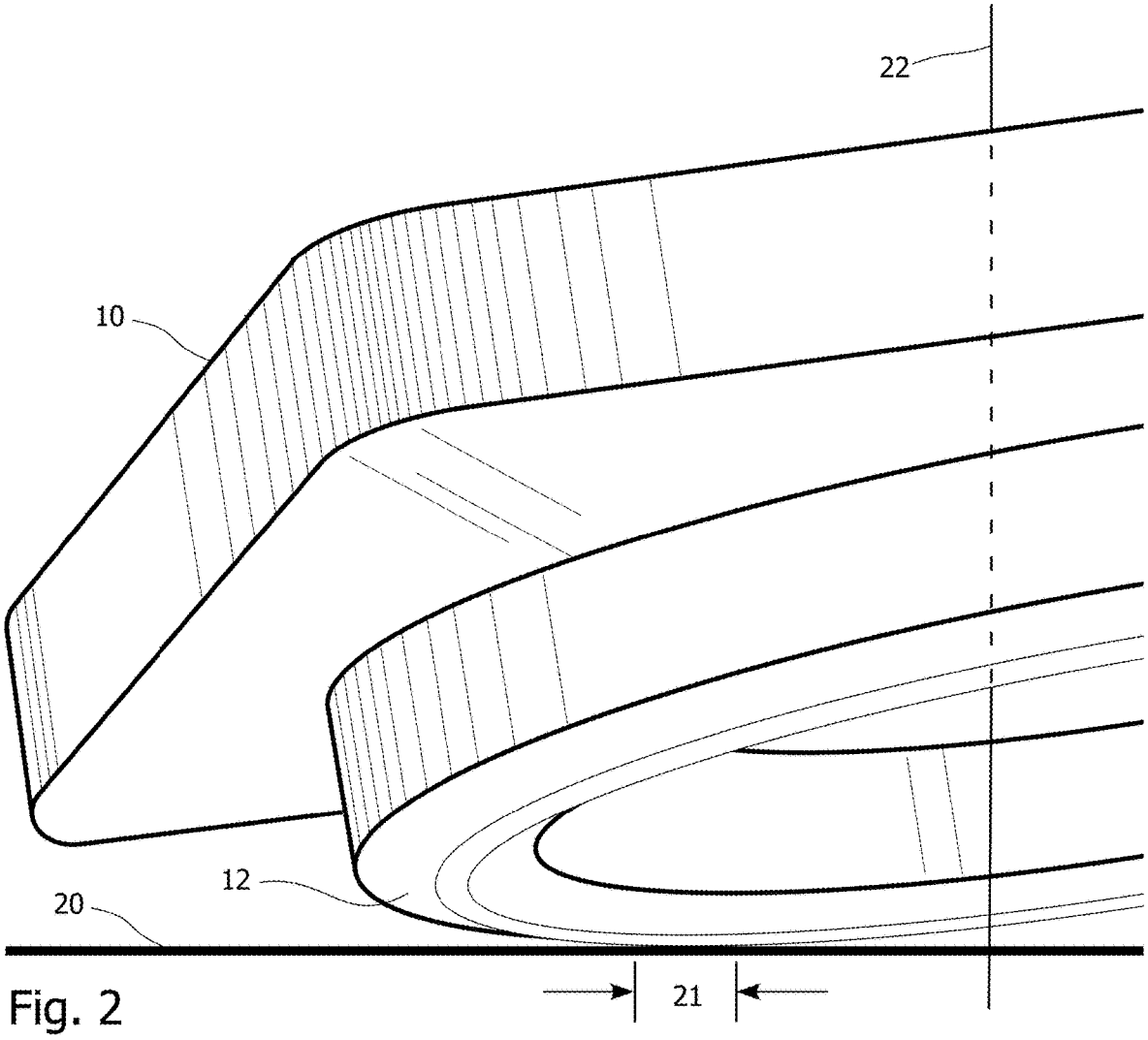
FIG. 2 shows a magnified section of key (10) with contact ring top surface (12) making contact with surface (20) below the key when the key is pressed down from the top.

FIG. 2 shows a magnified section of key (10) of FIG. 1, illustrating the contact ring top surface (12) making contact with a surface (20) below the key when the key is pressed down from the top in a manner causing the key to move downward at a slight angle to the horizontal, referenced by imaginary line (22) extending normal to surface (20) and up through the key. The result of the key contacting surface (20) with an angular attitude is that only a partial circumferential section (21) of the contact ring top surface makes contact with surface (20). Surface (20) would typically contain an electro-mechanical component, such as the flexible membrane switch shown in FIG. 4*c*, which discerns where a given contact section (21) is located along the circumference of the contact ring, resulting in the producing of an electrical signal indicating which of the key's activation positions section (21) corresponds to.

Figure 2A:
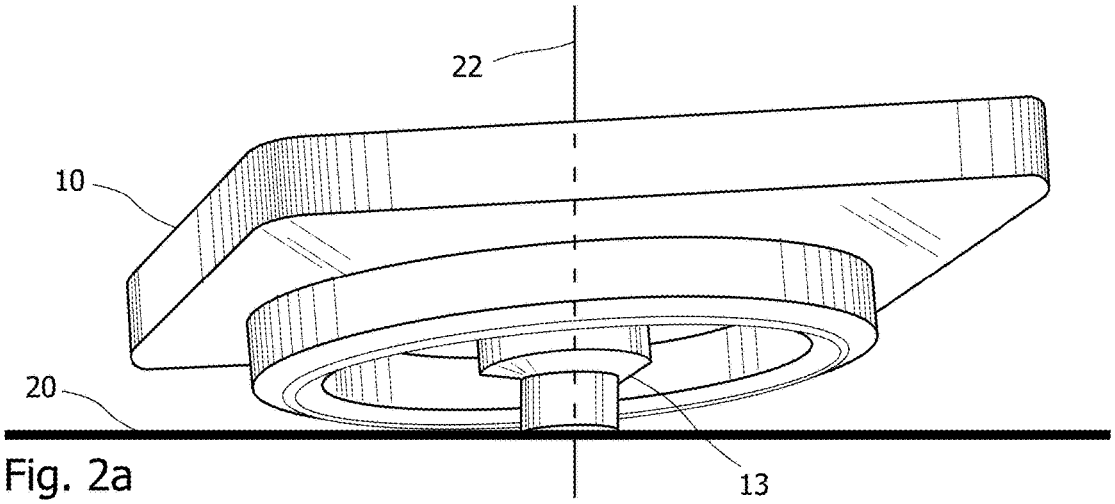
FIG. 2*a* shows center element (13) deforming slightly as key (10) is being pressed down at a slight angle to the horizontal causing center element (13) to be pressed down upon surface (20).

FIG. 2*a* shows center element (13) deforming slightly as key (10) is being pressed down at a slight angle to the horizontal and the center element is pressed down upon surface (20).

In FIGS. 1 and 2, the contact ring (11) is shown as a ring encircling an empty interior area; however, alternatively the interior area of the ring can be partially or completely filled in (solid), since the contact ring meets surface (20) below at an angle when the key is pressed down (FIG. 2 and FIGS. 5*a*-5*c*), and the interior area of the contact ring does not affect the operation of the invention in any way.

Figure 3A:
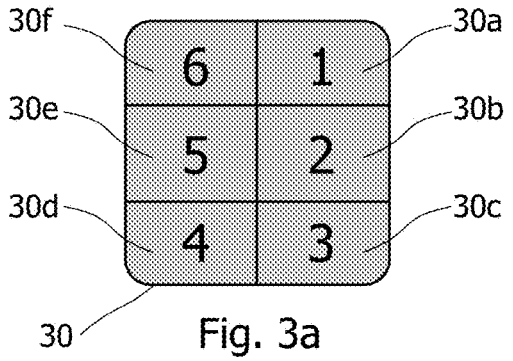
FIG. 3*a* shows the top face of key (30) with 6 activation positions, where the key top is divided into 6 segments (30*a*-30*f*).
Figure 3B:
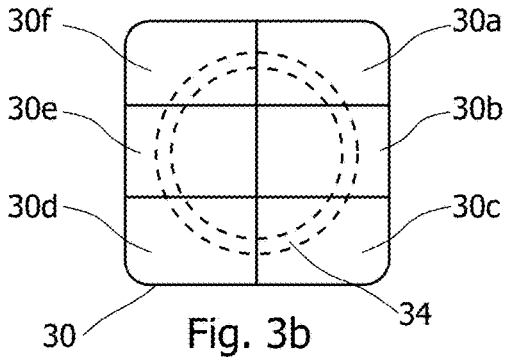
FIG. 3*b* shows contact ring (34), indicated by a dashed outline, as it would be seen if looking through the top of key (30).

FIG. 3*a* shows the top face of a key (30) with 6 activation positions, which can be a key such as (10), where the key top is divided, graphically and/or topographically, into 6 segments (30*a*-30*t*) with corresponding indicia marked 1 thru 6, respectively, on the face of the key. The area delineated by each segment defines the activation zone of each activation position of the key, such that if the key is pressed down anywhere within a given activation zone, it will cause actuation of its associated activation position. FIG. 3*b* shows contact ring (34), indicated by a dashed outline, as it would be seen if looking through the top of the key.

Figure 3C:
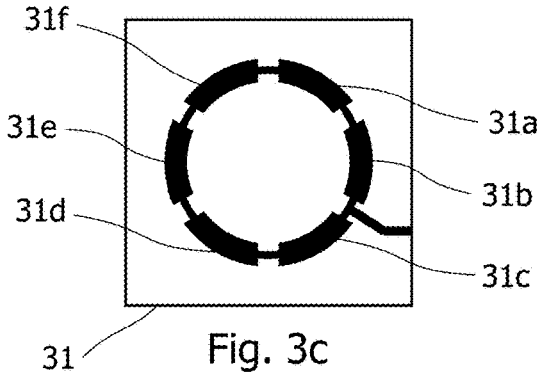
FIGS. 3*c* and 3*e* show the electrical contact arrangements of top layer (31) and bottom layer (33), respectively, of a flexible membrane switch positioned under key (30).
Figure 3F:
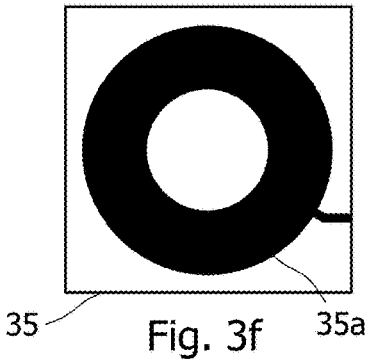
FIG. 3*f* shows an alternate top layer (35) with contact pattern (35*a*) that could be used with bottom layer (33) in the membrane switch.

For an embodiment wherein the detection mechanism underneath the key is a flexible membrane switch, typically constructed of thin sheets of polyester with electrically-conductive contacts, FIG. 3*c* shows the top layer (31) of a flexible membrane switch with its electrical contacts facing down, as if looking through from the top. Top layer (31) has 6 contacts (31*a*-31*t*) electrically connected together. FIG. 3*e* shows the bottom layer (33) of the switch with its 6 contacts (33*a*-33*t*) facing up. None of the contacts are electrically connected to each other. Only top layer (31) is required to be flexible and deform downward in response to pressure applied upon it; bottom layer (33) with upward-facing electrical contacts need not be of the same flexible material as top layer (31) and can be fabricated from a rigid or semi-rigid material of any desired thickness.

Figure 3D:
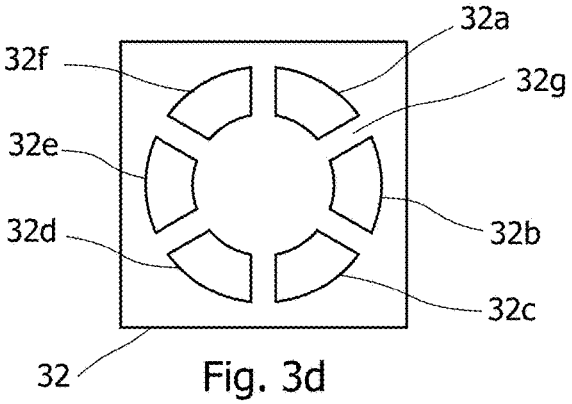
FIG. 3*d* shows electrically non-conductive spacer layer (32) with window cutouts (32*a*-32*f*), which is positioned between top and bottom layers (31) and (33) when the switch is assembled.

FIG. 3*d* shows an example of a separation layer (32) which is made of an electrically non-conductive material and serves as both a mechanical spacer and electrical insulator and is positioned between top and bottom layers (31) and (33) when the switch is assembled. The separation layer (32) has cutouts, or windows, (32*a*-32*f*), which correspond to the locations of contacts (31*a*-31*f*) and (33*a*-33*f*) and allow the top contacts to come into electrical contact with their corresponding bottom contacts when pressed down by the contact ring (34). In the example spacer shown in FIG. 3*d*, the windows (32*a*-32*t*) are separated by spans of spacer material (32*g*) between adjacent windows. The spans (32*g*) between the windows serve as separators between the activation positions, and the spans can be made narrower or wider to decrease or increase the operational separation between activation positions.

Figure 3G:
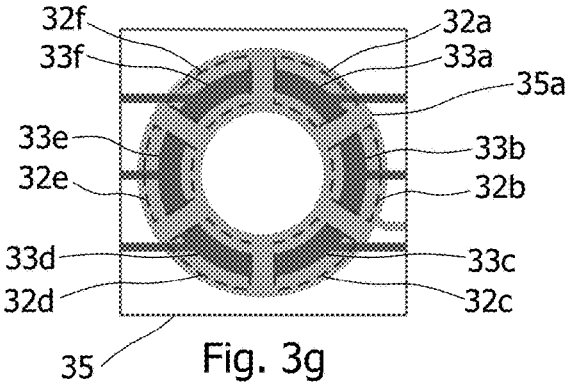
FIG. 3*g*, shows a top view of the multi-layer assembly of the membrane switch with top layer (35), spacer layer (32) beneath the top layer, and bottom layer (33) beneath the spacer layer.
Figure 3E:
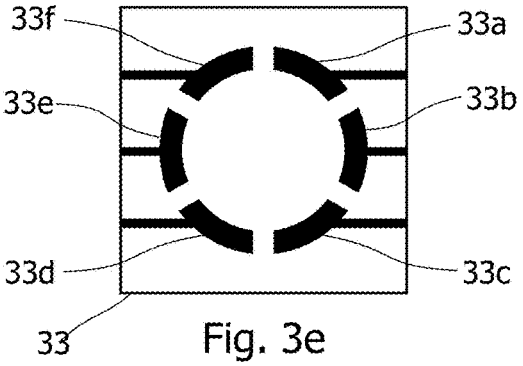

In the example shown in FIGS. 3*c* and 3*e*, the pattern of the contacts of the top and bottom layers, not including the connections to them, are identical: if placed one layer on top of the other, each top layer contact would be identical in size, shape and location to the bottom layer contact beneath it. FIG. 3*f* shows an example of an alternate top layer (35) that could be used with bottom layer (33) but its contact pattern (35*a*) does not have a 1:1 correspondence in shape or size to the contact pattern of (33). It is only required, as shown in the example of FIG. 3*g*, that the areas of the top contact pattern (35*a*) and bottom contact pattern (33*a*-33*f*) correspond within the window areas (32*a*-32*f*) of the separation layer where the contact ring will be pressing down to make an electrical connection between the layers.

Figure 4A:
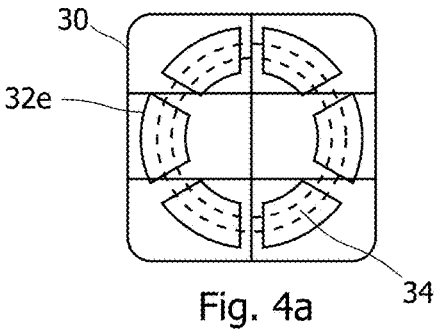
FIG. 4*a* shows the concentric positioning of the windows of the spacer layer (32) shown in FIG. 4*f* in relation to key (30) and its contact ring (34), shown in dashed lines.
Figure 4B:
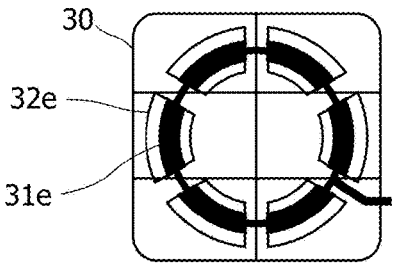
FIG. 4*b* shows the concentric positioning of the windows of the spacer layer in relation to the key and the contacts of top layer (31), shown in FIG. 4*e*.
Figure 4E:
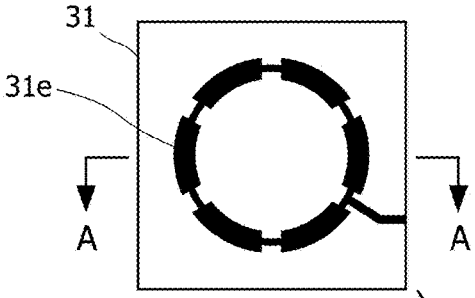
FIG. 4*c* shows cross-section (A-A) of an assembly consisting of, top to bottom: key (30) (FIG. 4*d*), top switch layer (31) (FIG. 4*e*), spacer layer (32) (FIG. 4*f*), and bottom switch layer (33) (FIG. 4*g*), at their respective cross-sections (A-A). The downward arrows (B) represent a downward force being applied to the top of the key at segment 5 (30*e*) shown in FIG. 4*d*.
Figure 4D:
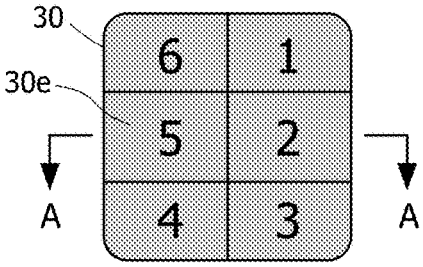
Figure 4F:
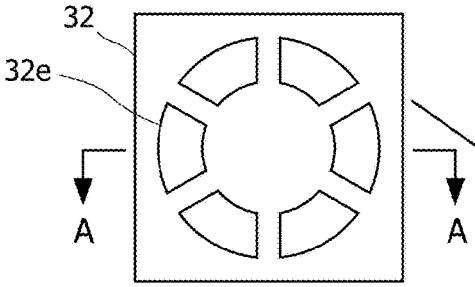
Figure 4C:
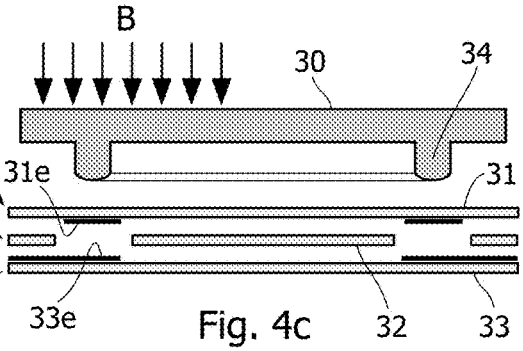
Figure 4G:
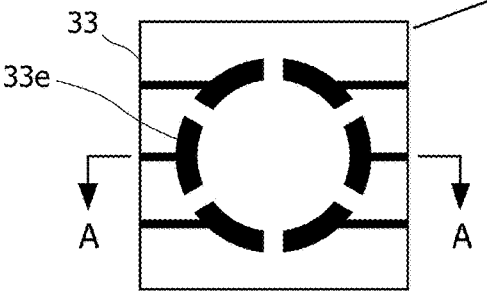

FIG. 4*c* shows a cross-section (A-A) of an assembly, consisting of, top to bottom: key (30), top switch layer (31), spacer layer (32), and bottom switch layer (33). FIGS. 4*d*-4*g* show the cross-section location (A-A) of those switch elements, respectively. FIG. 4*a* shows the concentric positioning of the windows of the spacer layer in relation to the key and its contact ring (34), and FIG. 4*b* shows the concentric positioning of the windows of the spacer layer in relation to the key and the top layer's contacts.

The downward arrows (B) in FIG. 4*c* represent a downward force being applied to the top of the key at segment 5 (30*e*); this would cause the contact ring (34) to press downward on contact (31*e*) of the top switch layer so that the top layer deforms downward through window (32*e*) of the spacer layer so that contact (31*e*) touches, and makes electrical contact with, bottom layer contact (33*e*). This would create an electrical connection actuating activation position 5 (30*e*) of the key.

In this embodiment of the switch design, each key activation position has its own spacer layer window through which the corresponding top and bottom switch layer contacts come together to make an electrical connection and actuate that activation position.

Figure 5A:
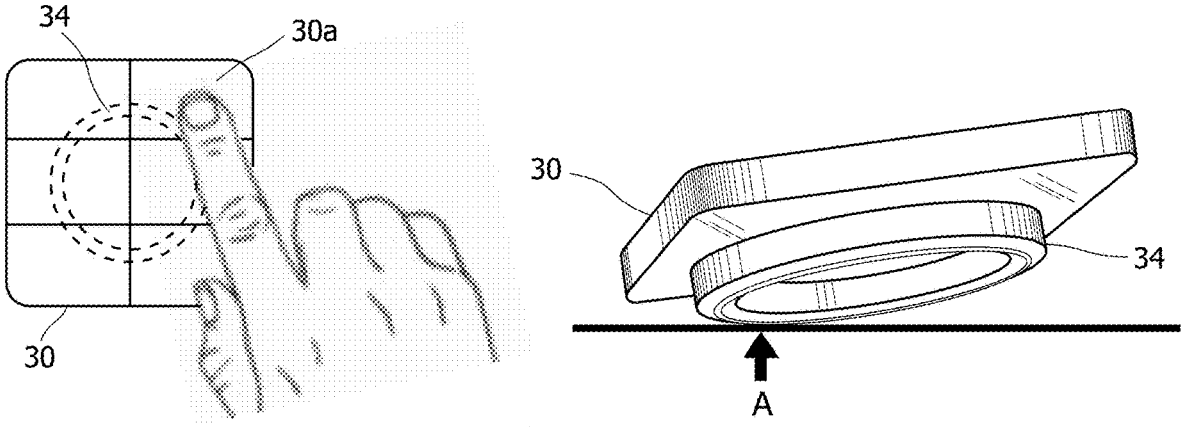
FIGS. 5*a*-5*c* show the result of a finger pressing down on key (30) at activation positions (30*a*), (30*b*) and (30*c*), respectively, causing the key to make contact with the surface beneath it at locations (A), (B) and (C), respectively.
Figure 5B:
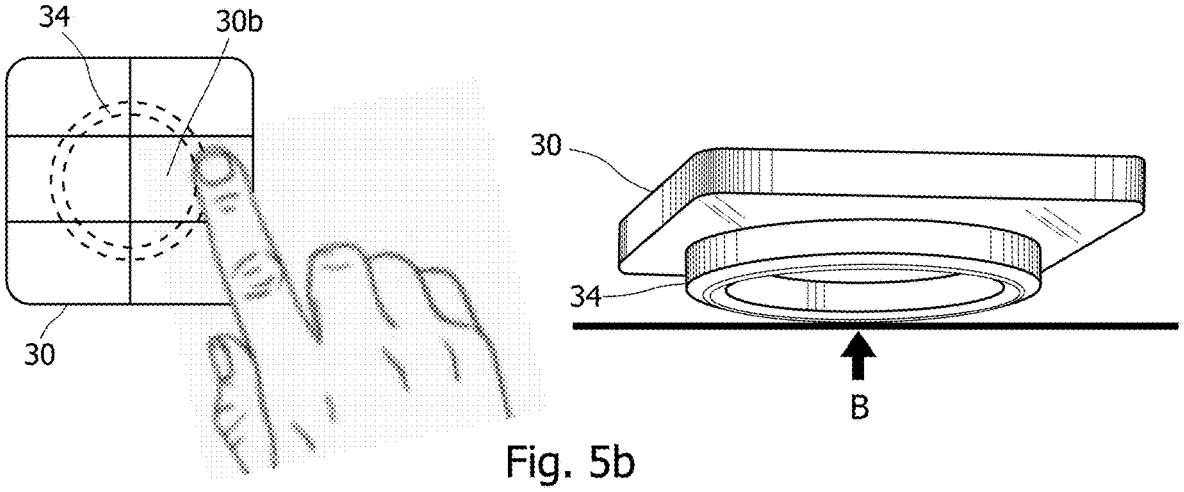
Figure 5C:
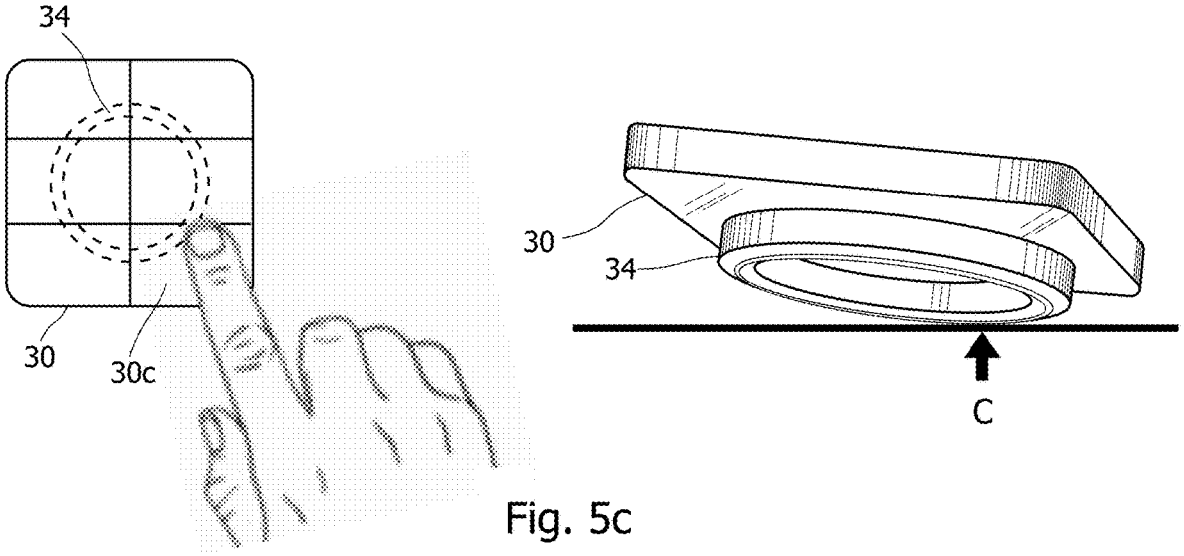
Figure 6A:
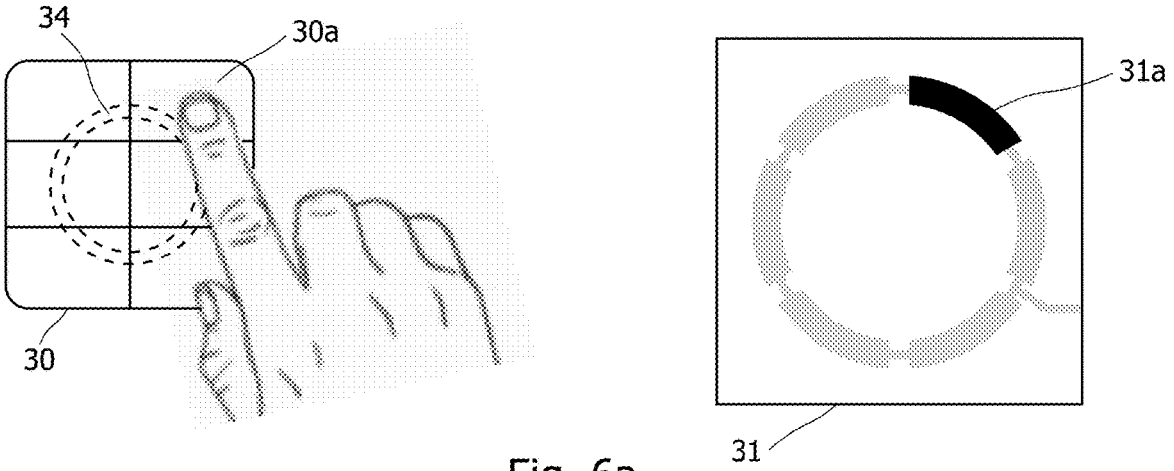
FIGS. 6*a*-6*c* show the result of a finger pressing down on key (30) at activation positions (30*a*), (30*b*) and (30*c*), respectively, causing the key to make contact with contacts (31*a*), (31*b*) and (31*c*), respectively, of top layer (31) of the membrane switch shown in FIG. 4*e*.
Figure 6B:
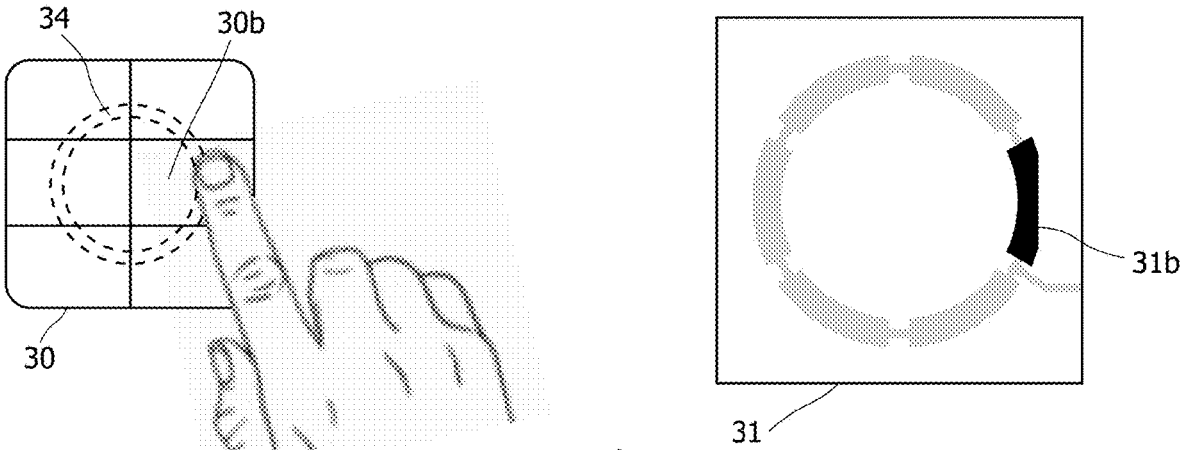
Figure 6C:
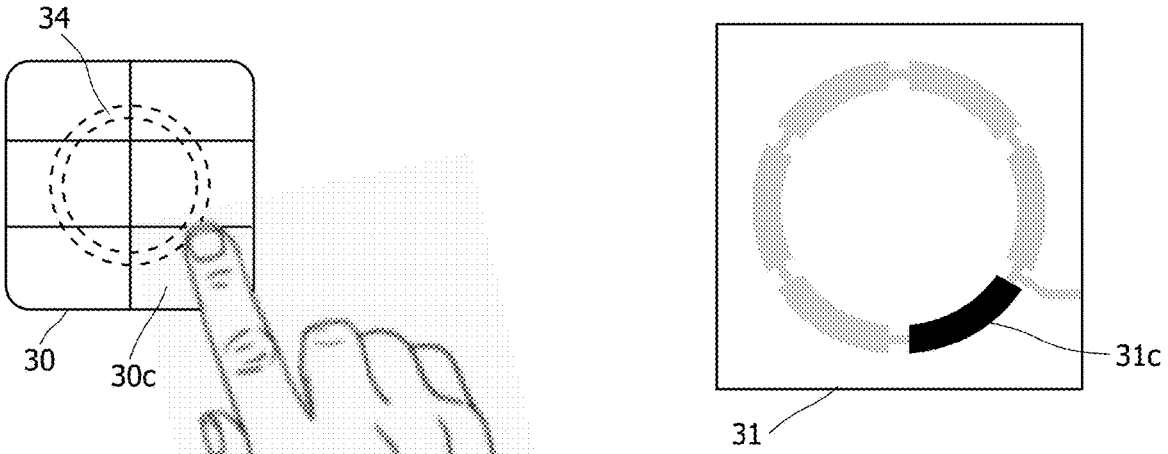

FIG. 5*a* shows the result of a finger pressing down on key (30) at activation position (30*a*). This causes the key to make contact with the surface beneath it at location (A), as explained in FIG. 2. If the key assembly is that shown in FIG. 4*c*, then this would cause contact ring (34) to press down on contact (31*a*) of top switch layer (31) as shown in FIG. 6*a*. FIG. 5*b* shows the result of a finger pressing down on the key at activation position (30*b*), which causes the key to make contact with the surface beneath it at location (B), resulting in contact ring (34) pressing down on contact (31*b*) as shown in FIG. 6*b*. FIG. 5*c* shows the result of a finger pressing down on the key at activation position (30*c*), which causes the key to make contact with the surface beneath it at location (C), resulting in contact ring (34) pressing down on contact (31*c*) as shown in FIG. 6*c*.

Figure 7A:
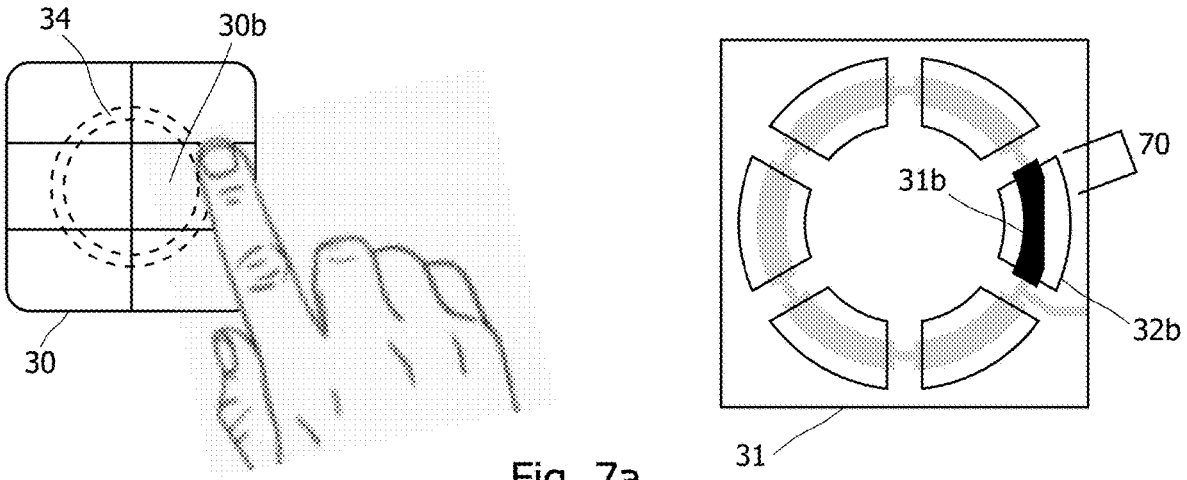
FIGS. 7*a*-7*c* show a finger pressing down on key (30) at activation position (30*b*), at 3 different points within that key segment, with the finger pressing at the locations shown in FIGS. 7*a*-7*c* causing contact ring (34) to press down on switch top layer (31) at contact sections (70), (71) and (72), respectively.
Figure 7B:
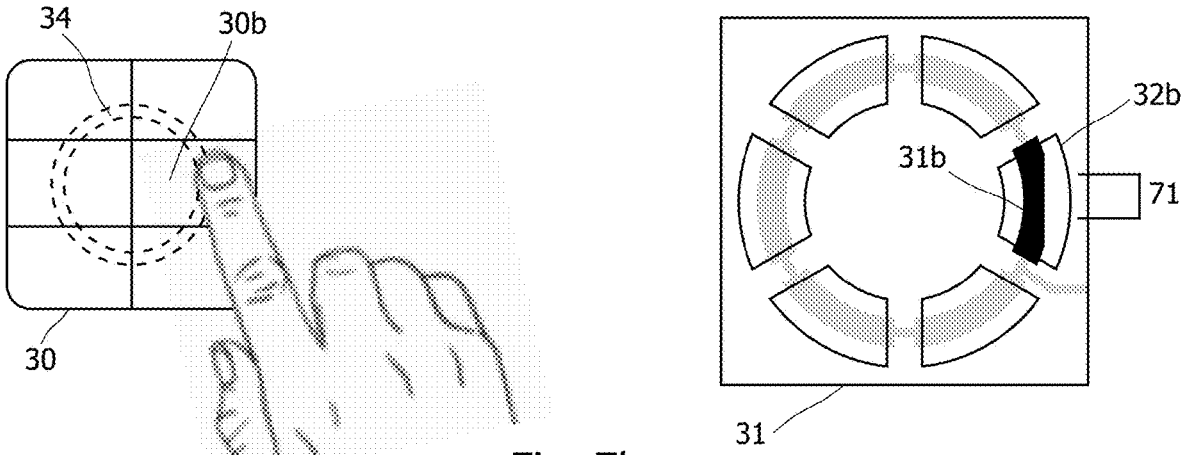
Figure 7C:
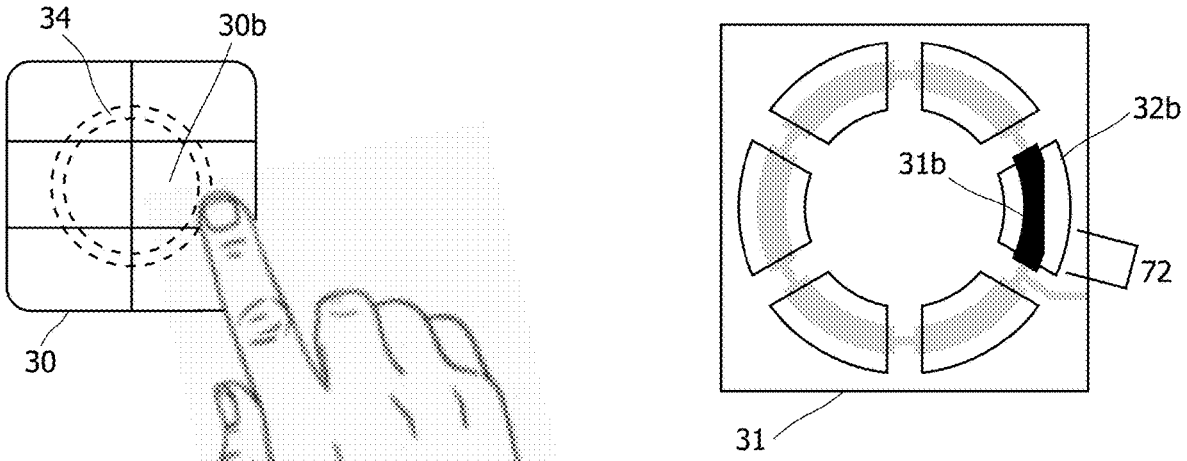

FIGS. 7*a*-7*c* show a finger pressing down on key (30) at activation position (30*b*), but at 3 different points within that key segment. For the finger pressing at the location shown in FIG. 7*a*, the contact ring (34) will press down on switch top layer (31) at contact section (70). For the finger pressing at the location shown in FIG. 7*b*, the contact ring (34) will press down on switch top layer (31) at contact section (71). For the finger pressing at the location shown in FIG. 7*c*, the contact ring (34) will press down on switch top layer (31) at contact section (72). Thus, the key can be pressed at various locations within a given key segment and will actuate that activation position as long as the contact section falls within the confines of the switch spacer layer window for that activation position.

Figure 8A:
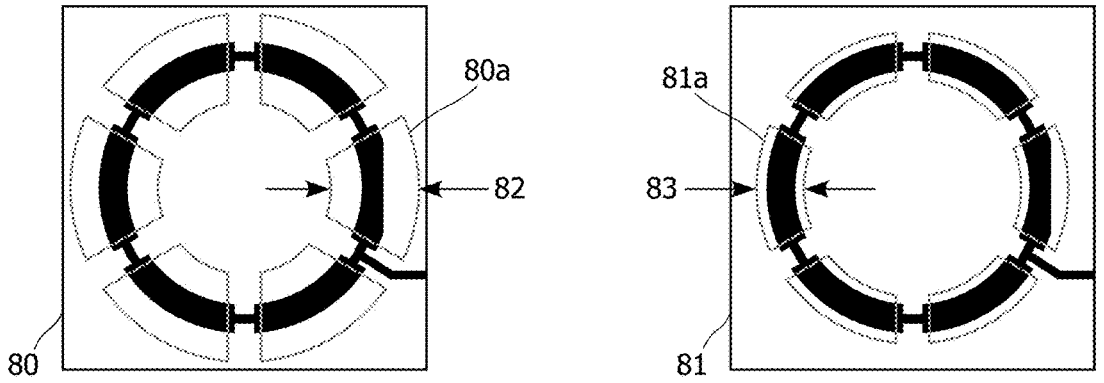
FIG. 8*a* shows a wide radial aperture width (82) of window (80*a*) in switch spacer layer (80) and a narrow radial aperture width (83) of window (81*a*) in switch spacer layer (81).

FIG. 8*a* shows how the radial width of the aperture of the windows in a switch spacer layer can be varied to tune the downward force, or actuation force, required to press down on the key to actuate an activation position. The examples show window (80*a*) having a wide aperture of width (82), and window (81*a*) having a narrow aperture of width (83). As the radial width of the window increases, less force is needed to cause the top switch layer to deform in order to press down upon the bottom switch layer. The thickness of the spacer layer will also affect required key actuation force: the thicker the spacer layer, the larger the distance separating the top and bottom switch layers, and thus the farther the top layer must deform to touch the bottom layer.

Figure 8B:
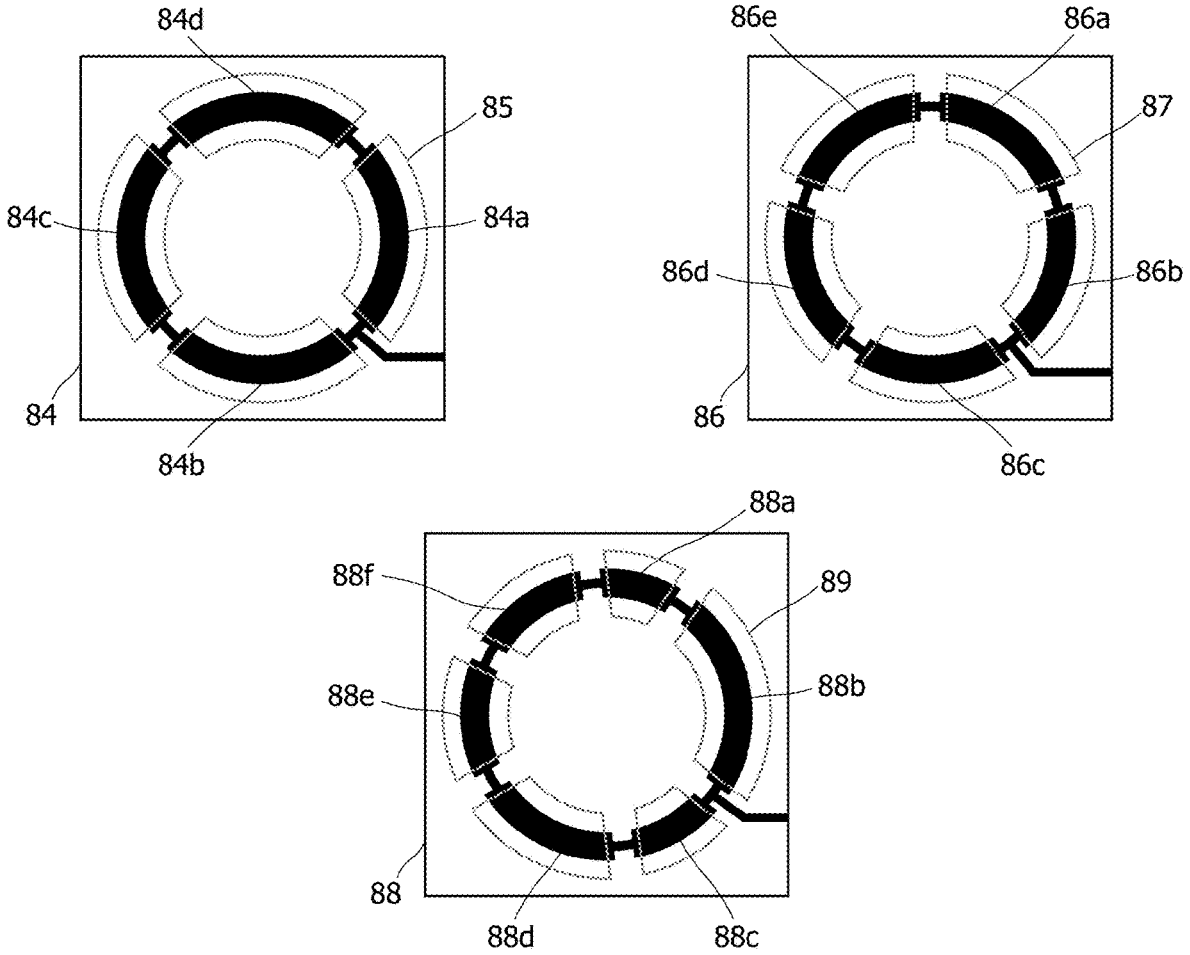
FIG. 8*b* shows top switch layer (84) for a 4-position key with contacts (84*a*-84*d*), top switch layer (86) for a 5-position key with contacts (86*a*-86*e*), and top switch layer (88) for a 6-position key with contacts (88*a*-88*f*) of varying arc lengths.

The number, locations, and sizes of activation positions on a key can be tailored to a specific application or requirement by varying the configuration of contacts on the top and bottom switch layers along with the corresponding windows in the switch spacer layer. FIG. 8*b* shows examples of this: top switch layer (84) for a 4-position key with contacts (84*a*-84*d*) and the corresponding spacer window (85) for each contact; top switch layer (86) for a 5-position key with contacts (86*a*-86*e*) and the corresponding spacer window (87) for each contact; and top switch layer (88) for a 6-position key with contacts (88*a*-881) and the corresponding spacer window (89) for each contact. As shown by the example of top switch layer (88), the activation zones of a key do not necessarily have to be the same size or in a symmetrical or regularly-spaced configuration.

In an alternate switch configuration, as shown and explained in FIGS. 9*a*-10*d* and Table 1, there is not a dedicated partitioned spacer window for each of the key's activation positions, such as shown in the example of FIG. 3*d*. There is also not a single top layer contact, with a single corresponding bottom layer contact, defining each activation position, such as shown in the examples of FIG. 3*c* and FIG. 3*e*.

Figure 9A:
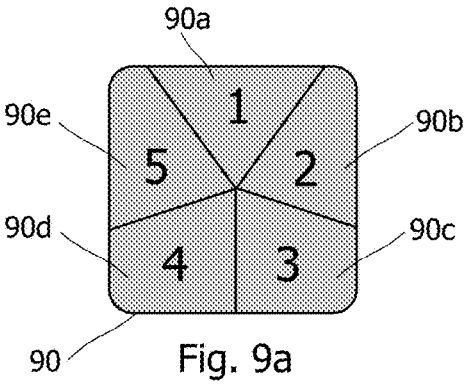
FIG. 9*a* shows key (90) with 5 activation positions (90*a*-90*e*).
Figure 9B:
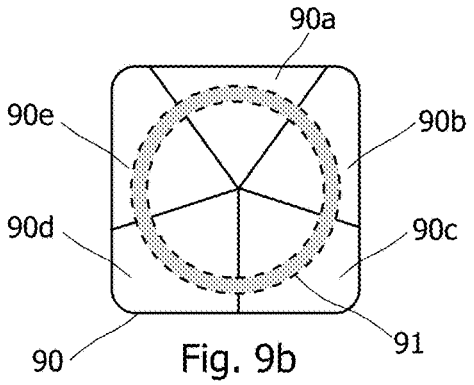
FIG. 9*b* shows contact ring (91), shaded and indicated by a dashed outline, as it would be seen if looking through the top of key (90).

FIG. 9*a* shows the top face of key (90), which can be a key such as (10), where the key top is divided, graphically and/or topographically, into 5 segments, or activation positions, (90*a*-90*e*) with corresponding indicia marked 1 thru 5, respectively, on the face of the key. FIG. 9*b* shows contact ring (91), shaded and indicated by a dashed outline, as it would be seen if looking through the top of the key.

Figure 9C:
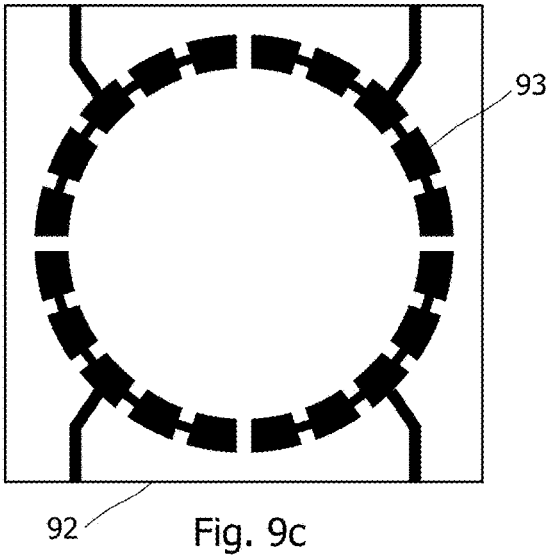
FIG. 9*c* shows the top layer (92) of a membrane switch with 20 contacts arranged in a circle, with the contacts electrically grouped into 4 groups.
Figure 9D:
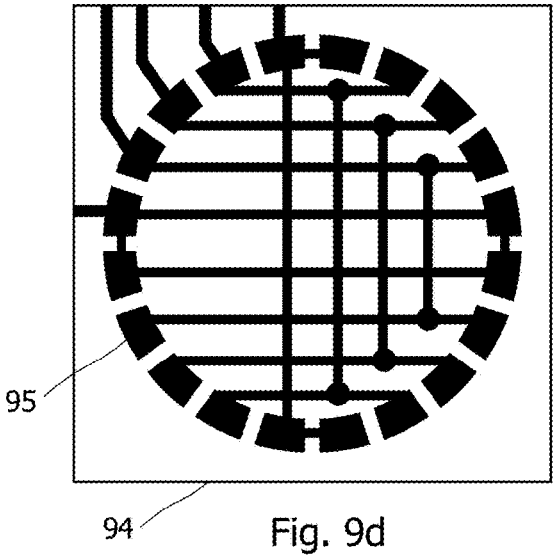
FIG. 9*d* shows the bottom layer (94) of a membrane switch with 20 contacts arranged in a circle, with the contacts electrically grouped into 5 groups

FIG. 9*c* shows the top layer (92) of a membrane switch that would be located below the key with its electrical contacts facing down, as if looking through from the top; it has 20 contacts arranged in a circle, and the contacts are electrically grouped into 4 groups. FIG. 9*d* shows the bottom layer (94) of the membrane switch located below the key; it has 20 contacts arranged in a circle, and the contacts are electrically grouped into 5 groups. In this example, the pattern of the contacts of the top and bottom layers, not including how they are connected, are identical: if placed one layer on top of the other, each top layer contact would be identical in size, shape and location to the bottom layer contact beneath it.

Figure 9E:
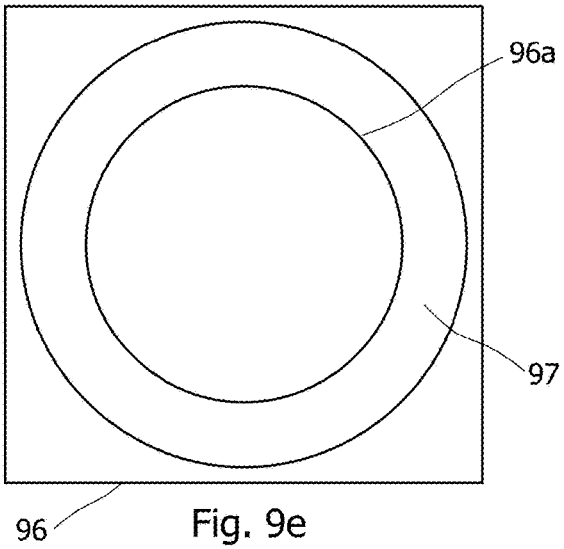
FIG. 9*e* shows switch spacer layer (96), with a window (97) between the top and bottom layers that is a continuous open circle.

FIG. 9*e* shows the switch spacer layer (96): the window (97) between the top and bottom layers is a continuous open circle, without any of the inter-window separations such as (32*g*) as shown in FIG. 3*d*. Such separations could be included but are not in the present example. Thus the center element (96*a*) of the spacer layer in this example is a separate piece of material centered within, but not connected to, the outer circle cutout of the spacer layer.

Figure 9F:
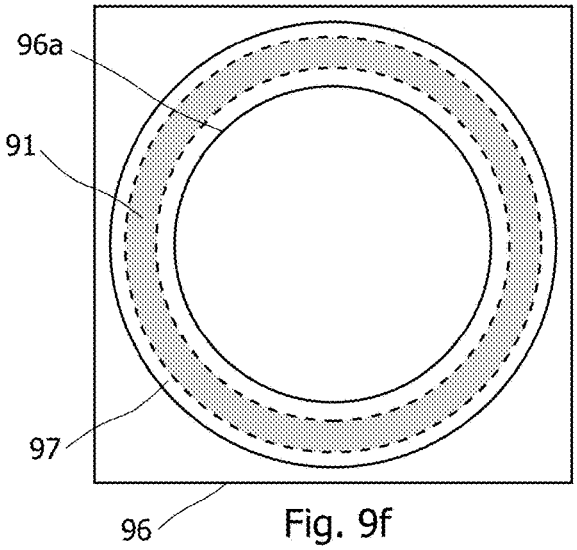
FIG. 9*f* shows the contact ring (91) concentrically aligned with respect to the spacer opening (97) in the key assembly.

FIG. 9*f* shows how the contact ring (91) would be concentrically aligned with respect to the spacer opening (97) in the key assembly. The key assembly would be in the same fashion as shown in FIG. 4*c*: each of the 20 contacts of the switch top layer would be directly above its corresponding bottom layer contact, and the key contact ring, switch top layer contacts, spacer layer, and bottom layer contacts would be vertically concentrically aligned, top to bottom, respectively.

FIGS. 10*a* and 10*b* show switch layers (92) and (94), with their circles of 20 contacts (93) and (95) labeled a-t and a'-t' respectively for purposes of illustration. The 4 groups of contacts in FIG. 10*a* are connected to circuit traces labeled 1-4, and the 5 groups of contacts in FIG. 10*b* are connected to circuit traces labeled A-E.

FIGS. 10*c* and 10*d* show a magnified view of contacts c-f (93). In an example configuration, FIG. 10*c* is a representation of the contact ring (91) making contact with switch layer (92) below it (as explained in FIG. 2) with a contact section arc (100) that spans twice the center-to-center pitch of the contacts (93). This contact section span (100) would, at any given location along the circle of contacts, press down on either 2 contacts simultaneously, such as d and e (FIG. 10*d*), or 3 contacts simultaneously, such as c, d, and e (FIG. 10*c*). As a result, in this configuration there would be 40 (2×20 contacts) distinct contact combinations: 20 with 2 contacts pressed simultaneously, and 20 with 3 contacts pressed simultaneously.

Table 1 is a truth table showing the key segment 1-5 (90*a*-90*e*) actuated for given simultaneous connecting of combinations of contacts t-h (93) of switch layer (92) with corresponding contacts t'-h' (95) of switch layer (94) positioned underneath it. Row 7 of the table shows the instance illustrated in FIG. 10*c*, where contacts c, d, and e are simultaneously pressed down and connect with corresponding contacts c', d', and e' underneath, respectively: the connecting of contact c with c' connects circuit traces 2 and C together, the connecting of contact d with d' connects circuit traces 2 and D together, and the connecting contact e with e' connects circuit traces 2 and E together. This is encoded by Table 1 as an actuation of key segment 2, indicated in the rightmost column.

The example contact configuration shown in FIGS. 9*c*, 9*d*, 10*a*, and 10*b* shows all contacts (93) and (95) as the same size, spaced uniformly around the circle; however, both the size of each individual contact, as well as individual inter-contact spacings, can be varied to suit different applications.

If a key construction incorporating flexible deformable materials resulted in a contact arc that varied in length depending on the amount of force being applied downward upon the key (e.g., a light pressure would span a contact pitch of 1, a greater pressure a pitch of 2, up to a pitch of 4 at maximum pressure), then a corresponding truth table could be constructed to provide for that. As an example: if only contact c (FIG. 10*a*) was pressed down, that would actuate key segment 2; if contacts t, a, b, and c were pressed down simultaneously, that would actuate key segment 1; if contacts a, b, c, and d were pressed down simultaneously, that would be in-between key segments 1 and 2, so no key segment would be actuated.

In this embodiment of the invention as illustrated by the examples in FIGS. 9*a*-10*d*, wherein the designated area on the key top for each key segment is determined by software (i.e., the configuration of the key's truth table such as Table 1), an additional feature is that a key's segments can be changed on the fly purely in software, allowing a key to have its key segment areas, as well as its number of key segments, dynamically changeable. By distinguishing applied pressure to the key through how many contacts, e.g., (93), are pressed down simultaneously, this design can also enable a pressure-sensitive functionality, such as providing a second key segment within a key segment: fewer contacts pressed within a key segment (light pressure) would actuate a primary signal for that key segment, and more contacts pressed within that key segment (exerting further pressure) would actuate a secondary signal for that same key segment.

Figure 11:
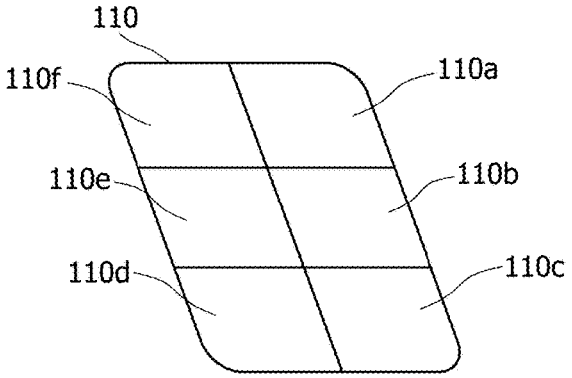
FIG. 11 shows an angled parallelogram key shape (110) with six activation positions (110*a*-110*f*).
Figure 11C:
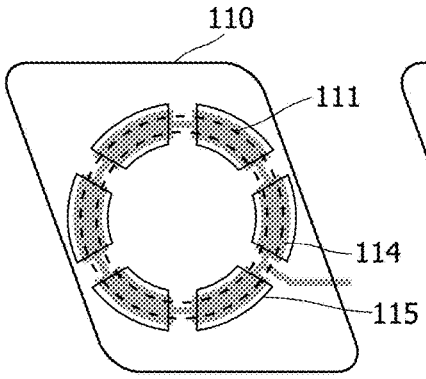
FIG. 11*c* shows the positions of electrical contacts (114) of a top switch layer and windows (115) of a spacer when arranged beneath key 110.
Figure 11A:
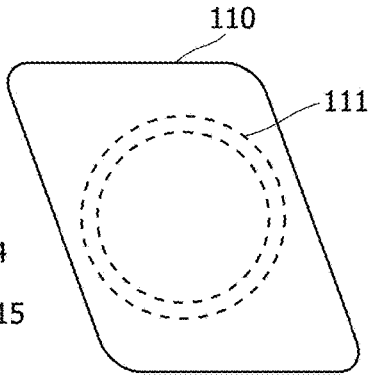
FIG. 11*a* shows key (110) with circular contact ring (111), indicated by a dashed outline, as it would be seen if looking through the top of the key.
Figure 11B:
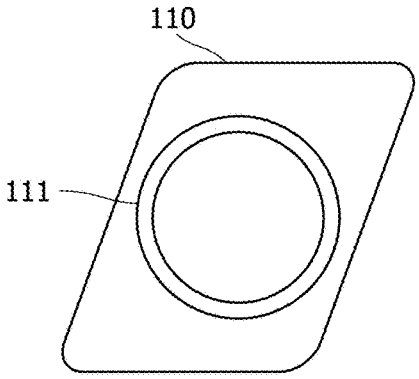
FIG. 11*b* shows key (110) from a bottom view, with contact ring (111).
Figure 11F:
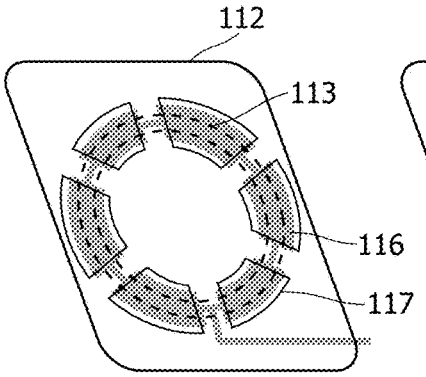
FIG. 11*f* shows the positions of electrical contacts (116) of a top switch layer and windows (117) of a spacer when arranged beneath key 112.
Figure 11D:
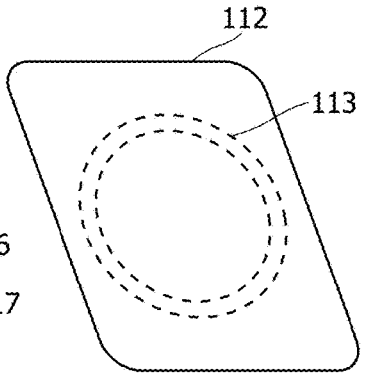
FIG. 11*d* shows key (112) with oval contact ring (113), indicated by a dashed outline, as it would be seen if looking through the top of the key.
Figure 11E:
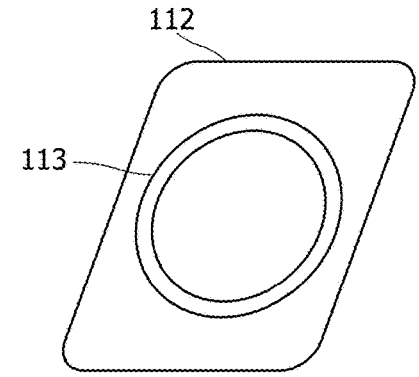
FIG. 11*e* shows key (112) from a bottom view, with contact ring (113).

The keys of this invention in the previous figures have been illustrated as squares, but a key of this invention can be implemented in a variety of shapes such as a circle, hexagon, etc., or even irregular shapes. As an example, FIG. 11 shows an angled parallelogram key shape (110) with six activation positions (110*a*-110*f*). Such a key can be used, for example, as a 6-position key for the keyboard invention taught in U.S. Pat. No. 7,131,780. FIG. 11*a* shows key (110) with contact ring (111), indicated by a dashed outline, as it would be seen if looking through the top of the key. FIG. 11*b* shows key (110) from a bottom view, with contact ring (111). The contact ring does not necessarily have to be a circle; FIGS. 11*d*-11*f* show key (112) with an oval contact ring (113). As with a circular contact ring such as (111), where the electrical contacts (114) and corresponding spacer windows (115) shown in FIG. 11*c* correspond to the shape and size of the circular contact ring, the electrical contacts (116) under key (112) and their corresponding spacer windows (117) shown in FIG. 11*f* would correspond to the shape and size of the oval contact ring (113).

Figure 12A:
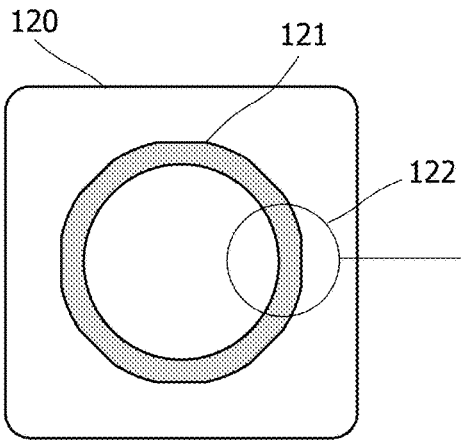
FIG. 12*a* shows key (120) with a circular contact ring (121) having straight facets positioned at various locations around the contact ring.
Figure 12B:
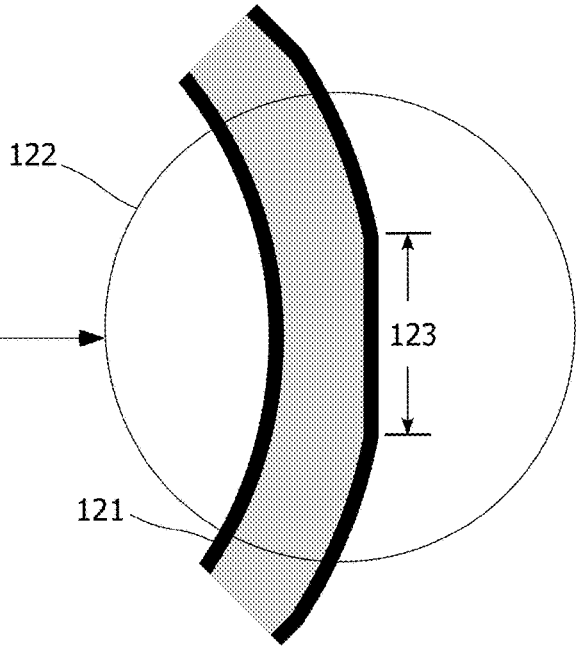
FIG. 12*b* shows a magnified section (122) of contact ring (121) with a straight facet of width (123).

FIG. 12*a* shows key (120) with a circular contact ring (121) having straight facets positioned at various locations around the contact ring. FIG. 12*b* shows a magnified section (122) of key (120) with a straight facet of width (123).

Figure 12C:
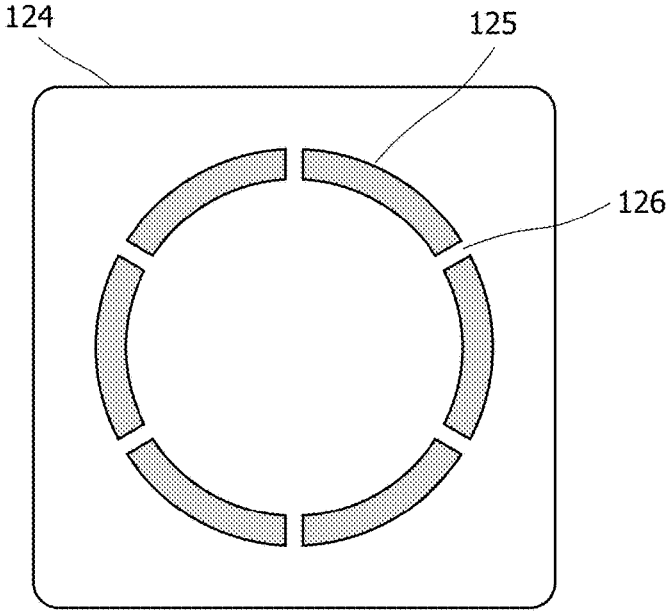
FIG. 12*c* shows key (124) with a contact ring (125) that is not a continuous circle, but rather has cutouts (126) located at various positions around the ring.

FIG. 12*c* shows key (124) with a circular contact ring (125) that is not a continuous circle, but rather has cutouts (126) located at various positions around the circle.

Figure 13:
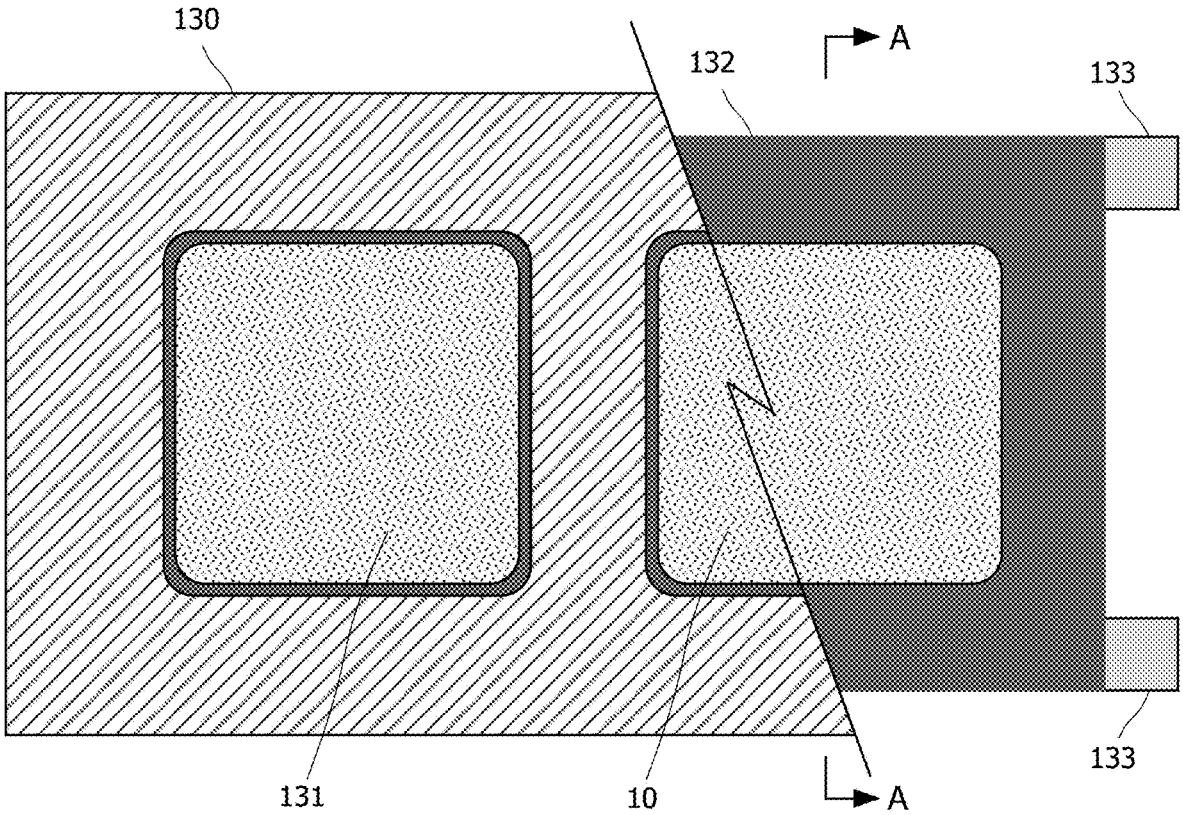
FIG. 13 shows 2 identical keys (10) and (131) surrounded by faceplate (130) and suspended across 2 support beams (133) by means of flexible material (132) attached to the underside of the keys.
Figure 13A:
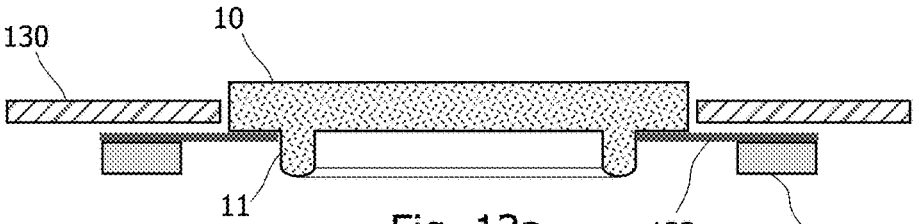
FIG. 13*a* shows a cross-section of FIG. 13 at A-A, with flexible material (132) attached to the underside of the key outside the area of the contact ring (11).

FIG. 13 shows an embodiment of a suspension for key (10). Two identical keys (10) and (131) are shown surrounded by a faceplate (130). The keys are suspended across 2 support beams (133) by means of a flexible material (132) which is attached to the underside of the key. FIG. 13*a* shows a cross-section of FIG. 13 at A-A, and shows the flexible material attached to the underside of the key outside the area of the contact ring (11).

Figure 13B:
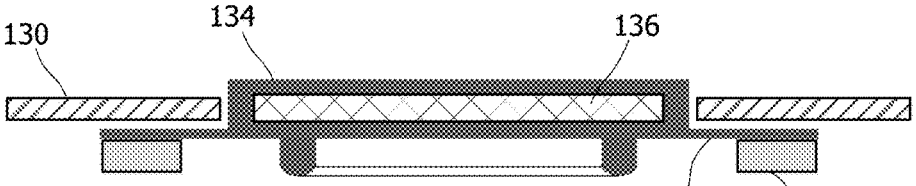
FIG. 13*b* shows a cross-section of key (134) in which the key is surrounded by flexible material (135) and has an internal core (136) consisting of a rigid material.

FIG. 13*b* shows a cross-section of a configuration similar to that of FIG. 13*a*, but instead of a separate flexible material attached to the key, the key (134) is also constructed from the same flexible material, with an internal core (136) made of a more rigid material, so that the key and flexible suspension (135) extending to the support beams (133) are a single piece.

Figure 14:
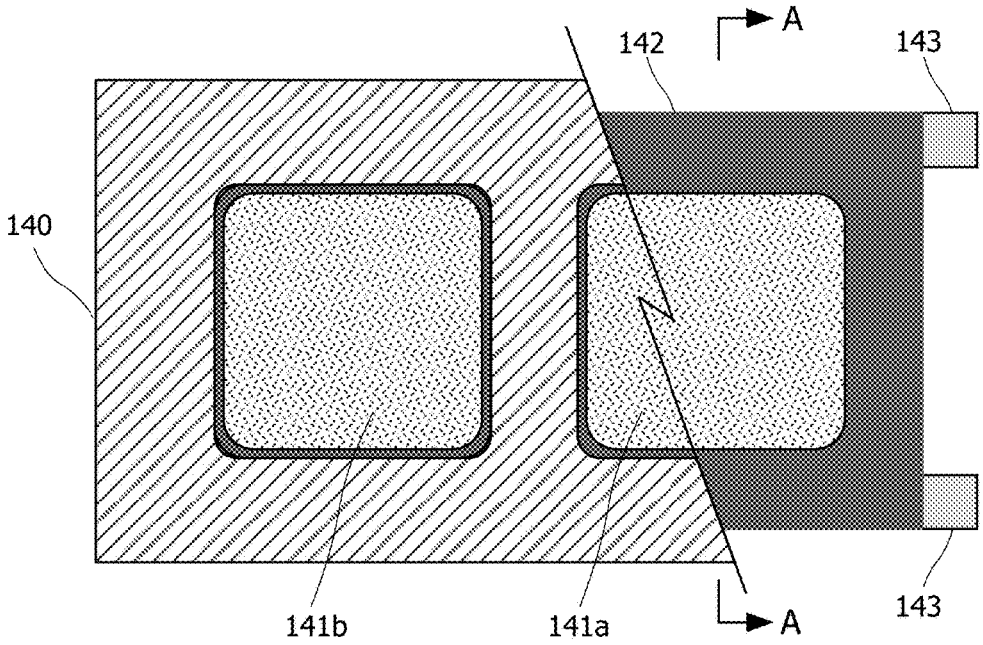
FIG. 14 shows 2 identical keys (141*a*) and (141*b*) surrounded by a faceplate (140) and suspended across 2 support beams (143) by a flexible material (142).
Figure 14A:
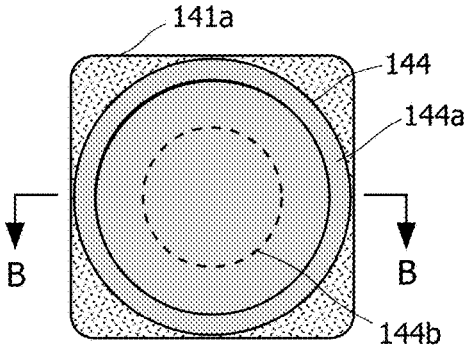
FIG. 14*a* shows key top (141*a*) viewed from the bottom and contact ring section (144).
Figure 14B:
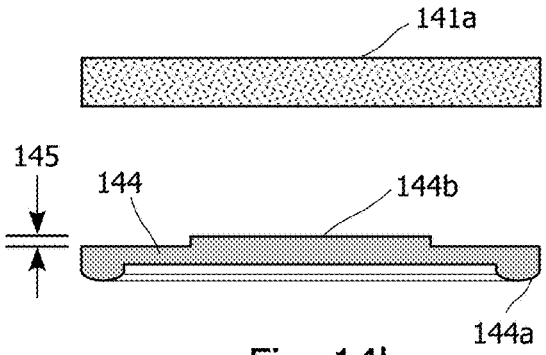
FIG. 14*b* shows in exploded B-B cross-section that key (141*a*) has a separate contact ring section (144).
Figure 14C:
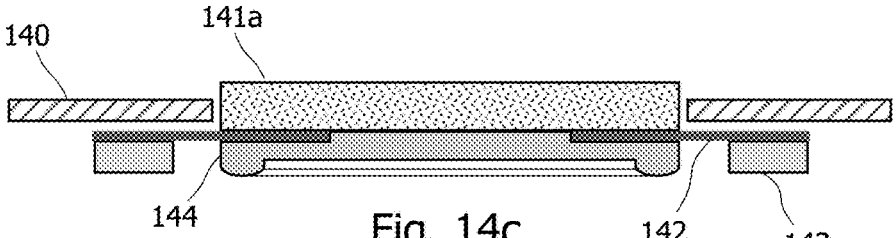
FIG. 14*c* shows cross-section A-A of FIG. 14, with the raised central circular surface (144*b*) shown in FIG. 14*b* attached to the bottom surface of the key top (141*a*), which captures the flexible support material (142) in-between the two.

FIG. 14 shows an embodiment similar to that shown in FIG. 13, with 2 identical keys (141*a*) and (141*b*) surrounded by a faceplate (140) and suspended across 2 support beams (143) by a flexible material (142). The keys are of a 2-piece construction. FIG. 14*a* shows key top (141*a*) viewed from the bottom and contact ring section (144), which are 2 separate pieces attached together. This is shown in the exploded B-B cross-section of FIG. 14*b*: key (141*a*) has a separate contact ring section (144) with a raised central circular surface (144*b*). FIG. 14*c* is cross-section A-A of FIG. 14, and shows the raised central circular surface (144*b*) shown in FIG. 14*b* attached to the bottom surface of the key top (141*a*), which captures the flexible support material (142) in-between the two. The gap (145) shown in FIG. 14*b* is just enough to allow the flexible support material) to fit securely between the top section and the contact ring section.

The 2-piece construction of this key allows the contact ring (144*a*) to extend to the outer edges of the key without encountering the problem of not having enough surface area on the key bottom on which to attach the suspension.

Figure 15A:
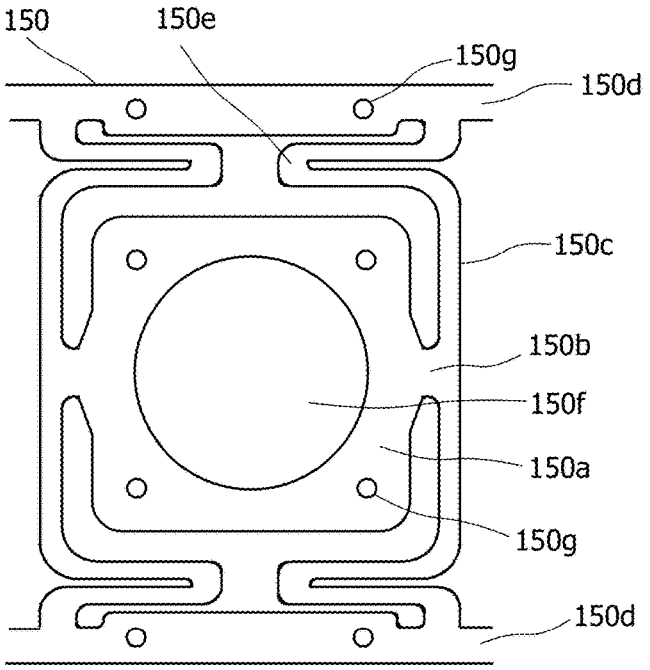
FIG. 15*a* shows a flexible suspension (150) for key (151) shown in FIG. 15*b*.
Figure 15B:
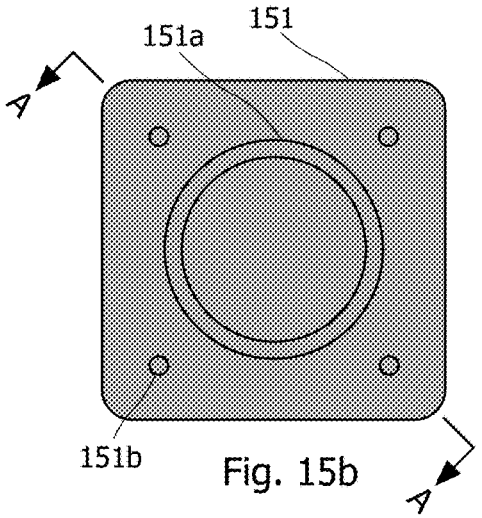
FIG. 15*c* shows A-A cross-section of key (151).
FIGS. 15*d* and 15*e* show a top and bottom view, respectively, of key (151) attached to suspension (150).
Figure 15D:
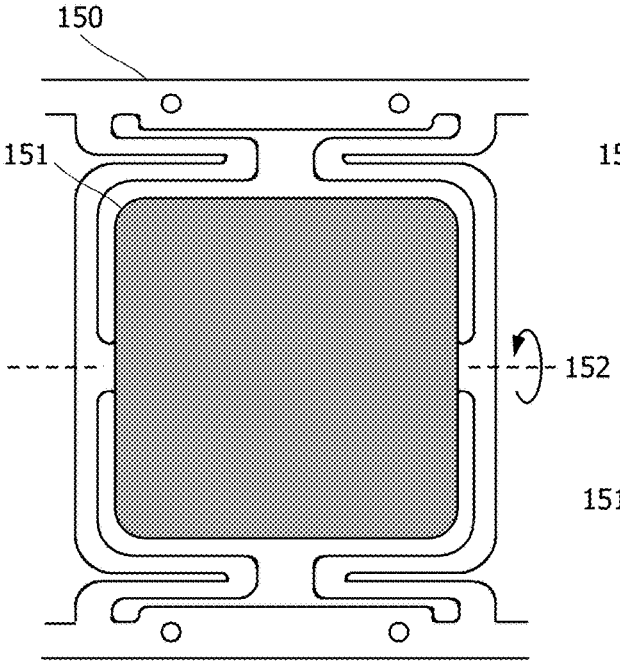
Figure 15E:
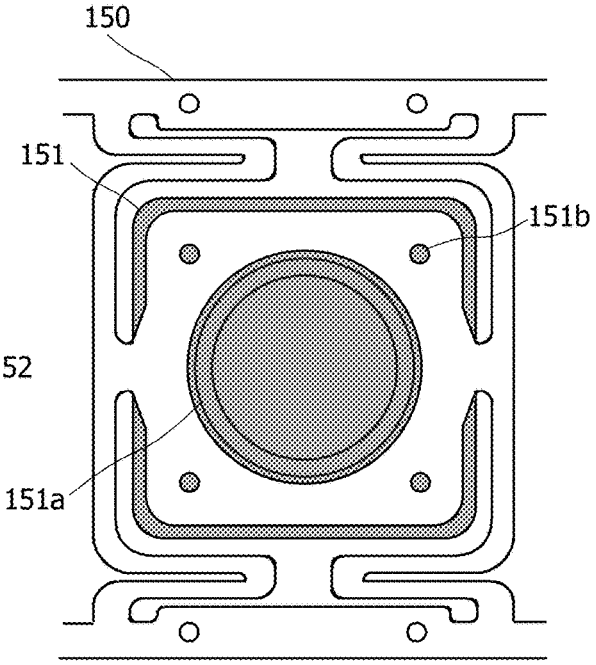
Figure 16:
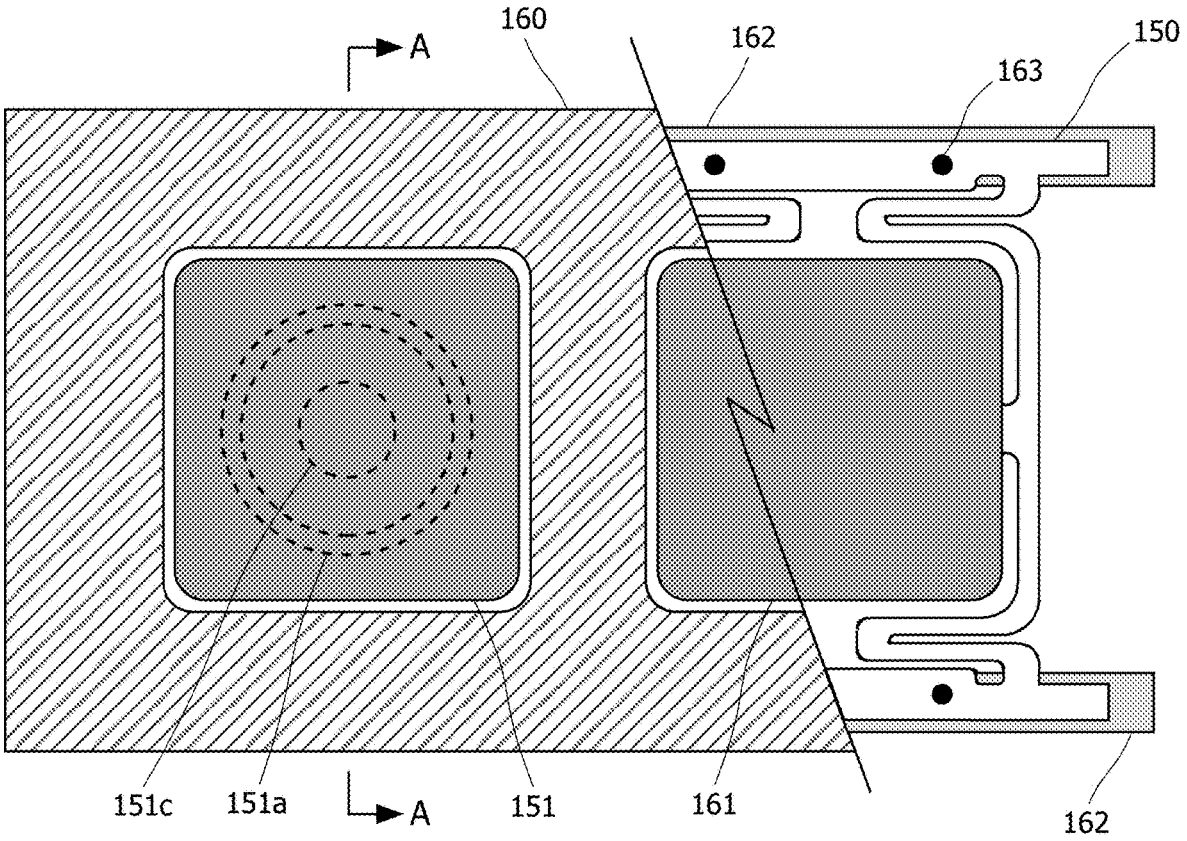
FIG. 16 shows 2 identical keys (151) and (161) surrounded by a faceplate (160) and suspended across 2 support beams (162) by suspension (150), and shows locations of contact ring (151*a*) and compressible snap action dome (151*c*) as they would be seen if looking through the top of key (151).

FIG. 15*a* shows a suspension (150) for key (151) shown in FIG. 15*b* with contact ring (151*a*). For this suspension to work optimally, it should be made out of a thin, flexible material such as spring steel. The suspension has a central section (150*a*) to which the key directly attaches, as shown in FIGS. 15*d* and 15*e*. This central section is connected to a side element (150*c*) on either side via a connecting element (150*b*). The side elements then connect to a top and bottom support element (150*d*) which would be anchored to a supporting structure such as shown in FIG. 16 to properly suspend the key.

Figure 15C:
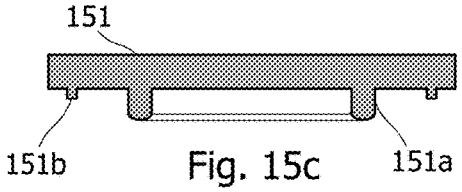

FIG. 15*b* shows the underside of key (151), which has a small cylindrical peg (151*b*) protruding near each corner, which is also shown in the A-A cross-section of key (151) in FIG. 15*c*. These pegs pass through their corresponding holes (150*g*) in the suspension to attach the key to the suspension, as shown in the bottom-side view of FIG. 15*e*. If the key is constructed of a material such as ABS or other plastic, these pegs can be heat-staked to form a strong and permanent attachment of the key to the suspension.

The objective of the design of this suspension is to allow the key to move freely and unconstrained—and with equal resistance—in any direction when pressed downward at activation areas on its top surface. This allows optimal functionality of the key. The serpentine bends (150*e*) of the side elements (150*c*) each act as an independent suspension at each of the corners of the key. In addition, the narrow connecting elements (150*b*) allow the key limited rotation about axis (152) shown in FIG. 15*d*.

The key motion can be tuned to a lighter or heavier force by varying a number of elements of the suspension, including the distance of the serpentine bends (150*e*), the width of the connecting elements (150*b*) and side elements (150*c*), the thickness and type of the suspension material, etc.

Figure 16A:
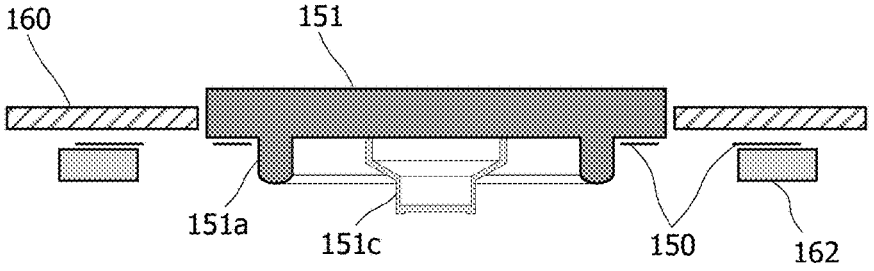
FIG. 16*a* shows key (151) A-A cross section of FIG. 16.

FIG. 16 shows an embodiment similar to that shown in FIG. 13, with 2 identical keys (151) and (161) surrounded by a faceplate (160) and suspended across 2 support beams (162) by suspension (150), which is attached to the support beams by means of fasteners (163). The keys each contain a compressible snap action dome (151*c*) beneath the bottom surface of the keys, such as (13) shown in FIGS. 1*c* and 2*a* and discussed in the description of FIG. 1*c* in the Detailed Description of the Drawings. The locations of contact ring (151*a*) and snap action dome (151*c*) as they would be seen if looking through the top of key (151) are indicated by dashed outlines. FIG. 16*a* shows key (151) A-A cross section of FIG. 16 including A-A cross-section of snap action dome (151*c*).

Figure 17A:
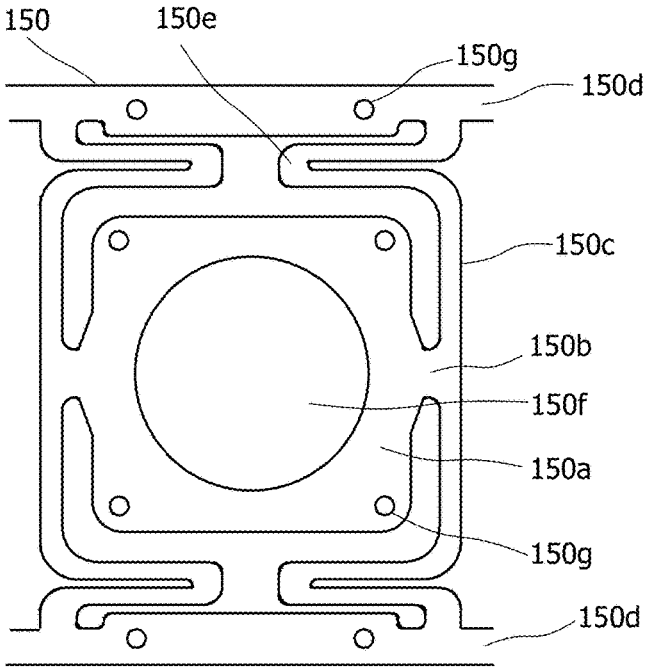
FIG. 17*a* shows suspension (150) from FIG. 15*a*.
Figure 17B:
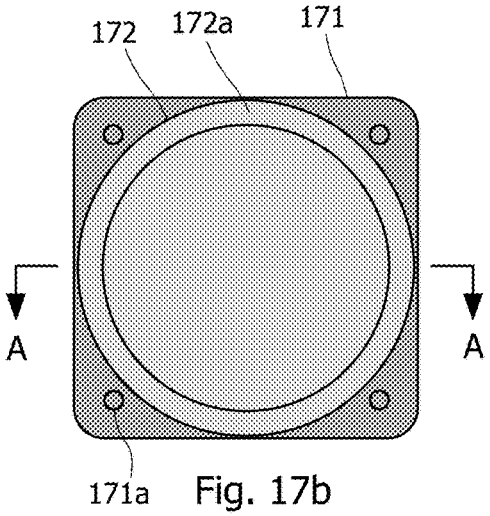
FIG. 17*b* shows key (171) viewed from the bottom and contact ring section (172).
Figure 17C:
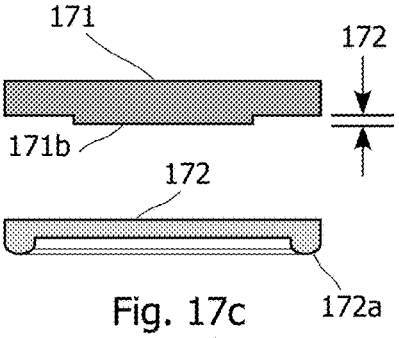
FIG. 17*c* shows in exploded A-A cross-section that key (171) has a separate contact ring section (172).
Figure 17D:
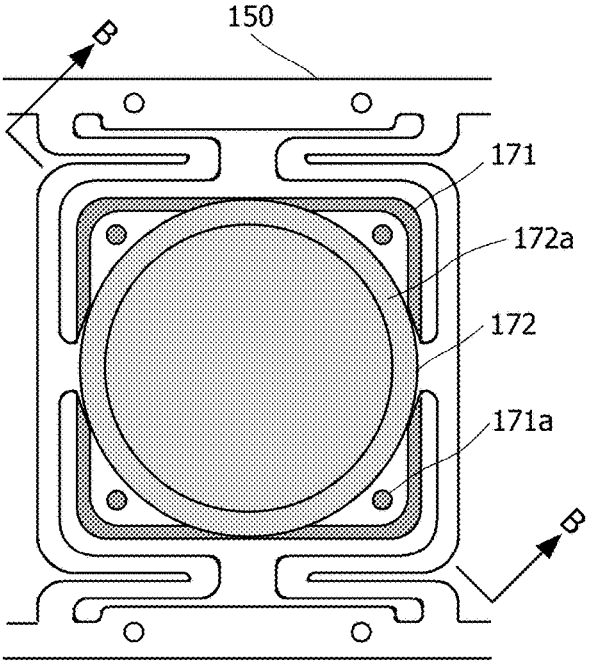
FIG. 17*d* shows a bottom view of key (171) attached to suspension (150).
Figure 17E:
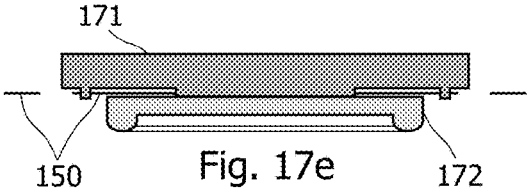
FIG. 17*e* shows B-B cross-section of key (171) with contact ring section (172) attached to suspension (150).

FIG. 17*d* shows, from a bottom view, how a 2-piece key design similar to that shown in FIGS. 14*a* and 14*b* would attach to suspension (150) from FIG. 15*a*. The key consists of a top key section (171) and a contact ring section (172) that attaches to the bottom of the top section, as shown in FIGS. 17*b*, 17*d* and 17*e*. FIG. 17*e* is the B-B cross-section of FIG. 17*d*: it shows the contact ring section is attached to the top key section at the raised circular surface (171*b*) shown in FIG. 17*c*, which is an exploded A-A cross-section of FIG. 17*b*. The gap (172) is just enough to allow the suspension (150) to fit securely between the top section and the contact ring section, as shown in cross-section FIG. 17*e*.

As shown in FIGS. 17*b* and 17*d*, the 2-piece construction of this key allows the contact ring (172*a*) to extend to the outer edges of the key while allowing the suspension's central section (150*a*) to remain a single piece with sufficient area for adequate strength and mechanical integrity.

The keys in FIG. 16 each include a compressible snap action dome which provides the user with a tactile response upon pressing the key. In the example embodiments of the present invention shown in FIGS. 18, 18*a*, and 18*b*, as well as FIGS. 19, 19*a* and 19*b*, a haptic actuator is employed to provide tactile response to the user. The function of the haptic actuator is to generate an output in the form of a mechanical pulse, vibration or other type of palpable perturbation which is conducted to and felt by the user's finger when pressing the key. As with tactile response provided by a snap dome, the haptic actuator-generated tactile response indicates to the user that the key press resulted in actuation of the key (e.g., for a typing keyboard, that a letter was successfully typed or entered).

A wide variety of haptic actuator device types and technologies can be utilized with the present invention, including but not limited to: magnetic, piezoelectric, electrostatic, and thermal. A 'haptic driver' or similar type of circuit can be used to generate an output to activate the haptic actuator and cause it to generate an output. Haptic drivers are commercially available as off-the-shelf integrated circuits or chip sets, which can include a voltage driver, wave shaping, and programmable memory as well as dynamic feedback functions. Alternatives for providing the desired functionality of the haptic driver include stand-alone custom-designed circuitry, elements in circuitry or devices that are combined with or used in conjunction with the present invention, as well as various combinations of both.

Figure 18:
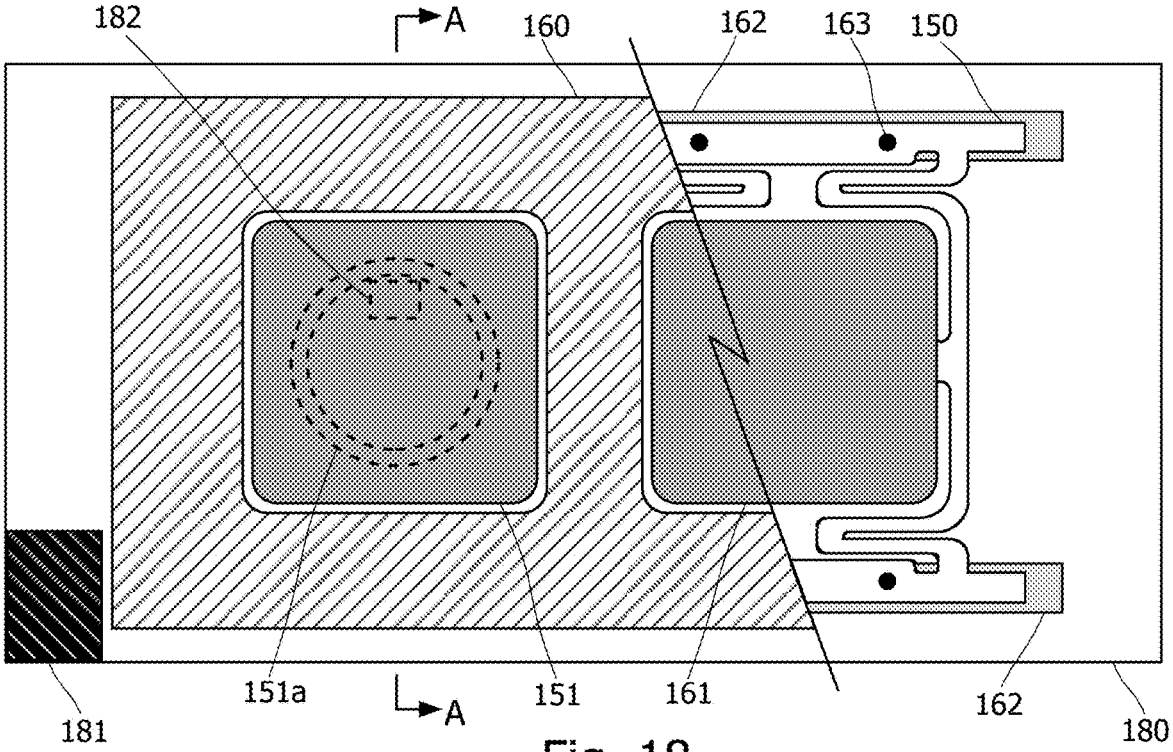
FIG. 18 shows 2 identical keys (151) and (161) surrounded by a faceplate (160) and suspended across 2 support beams (162) by suspension (150), with dashed outlines indicating locations of contact section (151*a*) and haptic actuator (182) as they would be seen if looking through the top of key (151). Beneath the keys is membrane switch (180). Also shown is haptic actuator (181) located on switch (180).

FIG. 18 shows an example switch assembly, similar that shown in FIG. 16, comprising 2 identical keys (151) and (161) surrounded by a faceplate (160) and suspended across 2 support beams (162) by suspension (150) which is attached to the support beams by means of fasteners (163).

Dashed outlines indicate the location of contact section (151*a*) and haptic actuator (182) as they would be seen if looking through the top of key (151). Beneath the keys in this example embodiment is membrane switch (180). Haptic actuator (181) is located on switch (180) and is attached to, incorporated into, or otherwise mechanically linked to it. Haptic actuator (181) serves to provide a tactile response for both keys: when a key makes contact with the membrane switch the haptic actuator-generated mechanical vibration is transmitted to the key and felt by the user's finger pressing the key. Haptic actuator (182) is located within the key (151) itself, and shows an example of each key in a group of keys having its own haptic actuator. FIG. 18*b* shows an example where the haptic actuator is attached to the underside of the key; FIG. 19*b* shows an example where the haptic actuator is embedded within the key.

Figure 18A:
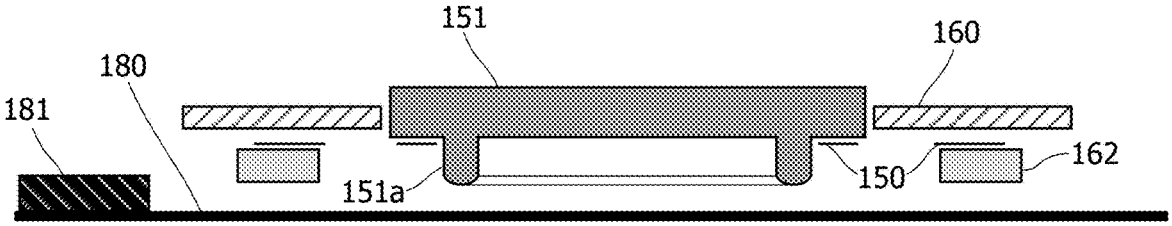
FIG. 18*a* is A-A cross-section of FIG. 18, showing an embodiment in which only haptic actuator (181) is utilized.
Figure 18B:
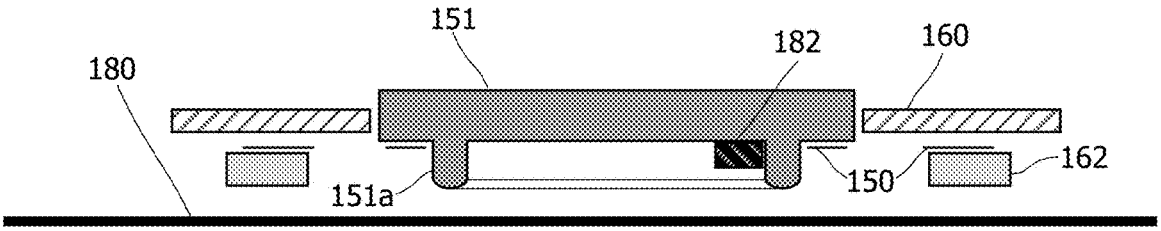
FIG. 18*b* is A-A cross-section of FIG. 18, showing an embodiment in which only haptic actuator (182) is utilized.

FIG. 18*a* is A-A cross-section of FIG. 18, showing an embodiment in which only haptic actuator (181) is utilized. FIG. 18*b* is A-A cross-section of FIG. 18, showing an embodiment in which only haptic actuator (182) is utilized.

FIG. 19 shows 2 keys (151) and (161) surrounded by a faceplate (160) and suspended across 2 support beams (162) by suspension (150) which is attached to the support beams by means of fasteners (163). Dashed outlines indicate locations of contact section (151*a*), a compressible element (190), and a haptic actuator (191) as they would be seen if looking through the top of key (151). Beneath the keys is membrane switch (180) which lies on rigid base surface (192) beneath it. Also shown is haptic actuator (181) located on base surface (192). Haptic actuator (181) is attached to, incorporated into, or otherwise mechanically linked to base surface (192) so that the actuator will transmit its mechanical output to any key touching switch (180) during the time the actuator is actuated.

Compressible element (190) serves to provide resistance to downward pressing of the key in addition to resistance produced from the movement of suspension (150), as well as then assisting in restoring the key to its neutral position once pressing forces have been removed from the key. The compression profile in terms of resistance force as a function of compression of the element can be chosen to suit each specific application and can be linear or non-linear (e.g., resistance increases non-linearly the further down the element is compressed). Materials such as spring steel, silicone, or other suitably flexible materials can be used to implement the compressible element.

FIG. 19*a* is A-A cross-section of FIG. 19, showing an embodiment in which only haptic actuator (181) is utilized. FIG. 19*b* is A-A cross-section of FIG. 19, showing an embodiment in which only haptic actuator (191) is utilized. In this example embodiment actuator (191) is completely embedded within the key structure. Alternate variations of the actuator placements shown in FIGS. 18*b* and 19*b* are possible, with the actuator partially embedded in the key, or attached or fastened to the key in alternate locations to those shown.

FIG. 20*a* shows the top face of key (200) where the key top is divided into 6 segments corresponding to 6 activation positions similar to key (30) in FIGS. 3*a* and 3*b*, each segment containing a numerical marking on the top face of the key. A contact section (201) of the key is indicated by a dashed outline as it would be seen if looking through the top of the key. A user's finger is shown pressing on segment (200*a*) having the numerical marking "2".

FIG. 20*b* shows a 3-layer membrane switch (202), such as the membrane switch shown in FIG. 4*c* comprising top layer (31), separation layer (32) and bottom layer (33). Switch (202) is located beneath key (200). In this example, switch (202) has a bottom layer constructed of a rigid material, as described in the detailed description of FIG. 3*e*. Switch activation position (203) lies directly beneath, and corresponds to, key segment (200*a*).

FIG. 20*c* shows a side view of key (200) resulting from a finger pressing down on the key at segment (200*a*) causing contact section (201) to make contact with membrane switch (202) beneath it and actuating the activation position (203) which is located directly beneath and corresponds to key segment (200*a*).

FIG. 20*d* shows an example application of the present invention. In response to a user pressing segment (200*a*) of key (200) as shown in FIG. 20*a* which causes contact section (201) to make contact with membrane switch (202) as shown in FIG. 20*c* and actuate activation position (203) shown in FIG. 20*b*: membrane switch (202) sends an actuation signal (205) to haptic driver circuit (206) which then generates electrical output pulse (207) to cause haptic actuator (181), located on switch (202), to generate a mechanical vibration or other type of palpable perturbation to provide the user a haptic response to pressing the key. Haptic actuator (181) is attached to, incorporated into, or otherwise mechanically linked to switch (202) so that the actuator will transmit its mechanical output to any keys touching switch (202) during the time the actuator is actuated. This example shows actuation signal (205) also being sent to keystroke processing circuit (208) which determines which of the 6 activation positions of the key was pressed (in this example, (200*a*)) and outputs signal (209) corresponding to the digit "2" which is the numeric marking on the top face of the key within segment (200*a*).

The example shown in FIG. 20*e* is identical to that shown in FIG. 20*d* with the exception that instead of haptic actuator (181) located on switch (202) there is haptic actuator (191) located within key (200), as shown in FIG. 19*b*, with dashed outlines indicated its location as if looking through the top of the key.

FIG. 21*a* shows an example output (205) from membrane switch (202) in the implementation shown in FIG. 20*d*. In this example, key actuation output (205) is the result of 3 sequential key presses which produce 3 key actuation signals (210), (211) and (212). The different widths of those signals show key (200) being pressed for different durations. Haptic driver output (207) consists of a single short pulse (213) each time the key is pressed. FIG. 21*b* shows the same example output (205) from membrane switch (202) resulting from 3 sequential key presses, with 3 key actuation signals (210), (211) and (212): in this example, the haptic driver produces a pulse (213) when the key is pressed, and then another, lower-amplitude pulse (214) when the key is released. Two pulses per keystroke—one on key press and another on key release—creates a dual-state 'oil can' snap action tactile response, which is typically employed in computer and typing keyboards.

The mechanical and timing characteristics of the haptic actuator output, such as force and waveform (shape, rise time, duration, etc.) can be controlled by the haptic driver circuit. Such parameter control can be a fixed setting in the haptic driver, or can be offered to the user via various types of user interfaces or controls which allow the user to adjust various characteristics of the haptic actuator output to suit their individual preferences for tactile response feel. Examples of varied haptic actuator outputs in consumer electronics devices range from a single crisp 'click' felt when touching a touchscreen or pressing a trackpad to offering distinctive vibrations that a user can set on their mobile phone to identify different callers. FIG. 22 shows user interface (220) added to the example application shown in FIG. 20*e*. User interface (220) can offer physical and/or software-based user interface functionality to enable the user to vary the tactile response feel for key presses. Parameter selections by the user via the user interface are input (221) to haptic driver circuit (206) to control the mechanical and timing output characteristics of haptic actuator (191) based on preferences set by the user.

For implementations of the present invention in which the keys are designed with the ability to be operated in rapid succession, such as a typing keyboard, there can also be provisions to have the haptic driver dynamically adjust the haptic actuator's output characteristics as a function of typing speed and/or duration of key presses, such as reducing the force and duration of the output as typing speed increases and conversely increasing those as typing speed decreases. FIG. 22 shows actuation signal (205) is input to haptic driver (206), which can analyze keystroke information to adjust haptic actuator (191) output characteristics based on keystroke speed and timing factors. Such adjustments can be made on a dynamic real-time basis, or can be made in various manners and intervals from historical or periodically-accumulated keystroke histories.

Having provided the disclosure of the illustrated embodiments, one skilled in the art may devise other embodiments and modifications which fall within the scope and sphere of the appended claims. In these further embodiments or modifications are deemed to be further embodiments of the present invention.

The invention claimed is:

1. A multiple-position momentary push switch comprising:

a key structure surrounded by a faceplate, the key structure includes a top surface having multiple pressing locations and a bottom surface from which a contact section protrudes;

a haptic actuator mechanism to provide a tactile response upon pressing any of the multiple pressing locations;

haptic driver means to activate the haptic actuator mechanism;

a detection mechanism comprising a plurality of electrical switches; and a suspension mechanism, distinct from the detection mechanism and extending from the key structure to a support element, holds the key structure in a neutral position and serves to return the key structure to the neutral position upon removal of pressing forces; wherein pressing different locations on the top surface of the key structure actuates a corresponding one or combination of the electrical switches, and causes the haptic driver means to activate the haptic actuator mechanism.

2. The multiple-position momentary push switch of claim 1, wherein the haptic actuator mechanism is attached to the key structure.

3. The multiple-position momentary push switch of claim 1, wherein the haptic actuator mechanism is embedded in the key structure.

4. The multiple-position momentary push switch of claim 1, wherein the detection mechanism includes a rigid structural layer; and the haptic actuator mechanism is attached to the rigid structural layer of the detection mechanism.

5. The multiple-position momentary push switch of claim 1, wherein the detection mechanism rests upon a rigid substrate; and the haptic actuator mechanism is attached to the rigid substrate.

6. The multiple-position momentary push switch of claim 1, wherein the haptic actuator mechanism provides a tactile response upon pressing any of the multiple pressing locations and a tactile response upon removal of pressing forces.

7. The multiple-position momentary push switch of claim 1, wherein the haptic driver means can vary the tactile response provided by the haptic actuator mechanism based on intervals between presses of the multiple pressing locations by the user.

8. The multiple-position momentary push switch of claim 1, wherein the haptic driver means can vary the tactile response provided by the haptic actuator mechanism based on duration of presses of the multiple pressing locations by the user.

9. The multiple-position momentary push switch of claim 1, wherein the haptic driver means can vary the tactile response provided by the haptic actuator mechanism based on duration of and intervals between presses of the multiple pressing locations by the user.

10. A multiple-position momentary push switch comprising:

a key structure surrounded by a faceplate, the key structure includes a top surface having multiple pressing locations and a bottom surface from which a contact section protrudes;

a compressible element located beneath the key structure;

a haptic actuator mechanism to provide a tactile response upon pressing any of the multiple pressing locations;

haptic driver means to activate the haptic actuator mechanism;

a detection mechanism comprising a plurality of electrical switches; and a suspension mechanism, distinct from the detection mechanism and extending from the key structure to a support element, holds the key structure in a neutral position and serves to return the key structure to the neutral position upon removal of pressing forces; wherein pressing different locations on the top surface of the key structure actuates a corresponding one or combination of the electrical switches, and causes the haptic driver means to activate the haptic actuator mechanism.

11. The multiple-position momentary push switch of claim 10, wherein the compressible element provides resistance to pressing forces upon the top surface of the key structure.

12. The multiple-position momentary push switch of claim 10, wherein the haptic actuator mechanism is attached to the key structure.

13. The multiple-position momentary push switch of claim 10, wherein the haptic actuator mechanism is embedded in the key structure.

14. The multiple-position momentary push switch of claim 10, wherein the detection mechanism includes a rigid structural layer; and the haptic actuator mechanism is attached to the rigid structural layer of the detection mechanism.

15. The multiple-position momentary push switch of claim 10, wherein the detection mechanism rests upon a rigid substrate; and the haptic actuator mechanism is attached to the rigid substrate.

16. The multiple-position momentary push switch of claim 10, wherein the haptic actuator mechanism provides a tactile response upon pressing any of the multiple pressing locations and a tactile response upon removal of pressing forces.

17. A multiple-position momentary push switch comprising:

a key structure surrounded by a faceplate, the key structure includes a top surface having multiple pressing locations and a bottom surface from which a contact section protrudes;

a haptic actuator mechanism to provide a tactile response upon pressing any of the multiple pressing locations;

haptic driver means to activate the haptic actuator mechanism;

user interface means to allow user control of the haptic driver means;

a detection mechanism comprising a plurality of electrical switches; and a suspension mechanism, distinct from the detection mechanism and extending from the key structure to a support element, holds the key structure in a neutral position and serves to return the key structure to the neutral position upon removal of pressing forces; wherein pressing different locations on the top surface of the key structure actuates a corresponding one or combination of the electrical switches, and causes the haptic driver means to activate the haptic actuator mechanism.

18. The multiple-position momentary push switch of claim 17, wherein the user interface means allows the user to vary the tactile response provided by the haptic actuator mechanism by selecting one or more options to control variations in the activation of the haptic actuator mechanism by the haptic driver means.

19. The multiple-position momentary push switch of claim 17, wherein the haptic actuator mechanism provides a tactile response upon pressing any of the multiple pressing locations and a tactile response upon removal of pressing forces.

* * * * *